US010537786B2

(12) United States Patent
Azuma et al.

(10) Patent No.: US 10,537,786 B2
(45) Date of Patent: Jan. 21, 2020

(54) LOTTERY DEVICE AND GAME MACHINE USING SAME

(71) Applicant: KONAMI DIGITAL ENTERTAINMENT CO., LTD., Tokyo (JP)

(72) Inventors: Shogo Azuma, Tokyo (JP); Kensaku Yoshida, Tokyo (JP); Toshihiro Kusano, Tokyo (JP); Kazuo Tsubota, Tokyo (JP)

(73) Assignee: KONAMI DIGITAL ENTERTAINMENT CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/102,072

(22) Filed: Aug. 13, 2018

(65) Prior Publication Data

US 2018/0345125 A1 Dec. 6, 2018

Related U.S. Application Data

(63) Continuation of application No. PCT/JP2017/003999, filed on Feb. 3, 2017.

(30) Foreign Application Priority Data

Feb. 17, 2016 (JP) ..... 2016-028418

(51) Int. Cl.

| | |
|---|---|
| ***G07F 17/32*** | (2006.01) |
| ***A63F 5/02*** | (2006.01) |
| ***A63F 5/00*** | (2006.01) |
| ***A63F 9/24*** | (2006.01) |

(52) U.S. Cl.

CPC ..... *A63F 5/02* (2013.01); *A63F 5/0011* (2013.01); *A63F 5/0076* (2013.01); *A63F 9/24* (2013.01);

(Continued)

(58) Field of Classification Search

CPC ..... A63F 5/02; A63F 5/0011; A63F 5/0076; A63F 9/24; A63F 2009/2442; G07F 17/329

See application file for complete search history.

(56) References Cited

U.S. PATENT DOCUMENTS 5,799,940 A * 9/1998 Tripp ..... A63F 7/048 273/144 B
6,164,646 A * 12/2000 Uehara ..... A63F 5/00 273/142 R (Continued)

FOREIGN PATENT DOCUMENTS

| | | |
|---|---|---|
| JP | 2004-97487 A | 4/2004 |
| JP | 2011-88019 A | 5/2011 |
| WO | 2015/037091 A1 | 3/2015 |

OTHER PUBLICATIONS

Communication dated Dec. 20, 2017 from the Japanese Patent Office in counterpart Application No. 2016-028418.

(Continued)

*Primary Examiner* — Corbett B Coburn
(74) *Attorney, Agent, or Firm* — Sughrue Mion, PLLC

(57) ABSTRACT

A lottery device includes: a drawing body having medium entrance units which are provided along a circumferential direction thereof, and into each of which a game medium can enter; a driving mechanism driving the drawing body in the circumferential direction; a dividing device dividing a periphery of a path of the medium entrance units, in which path the medium entrance units travel, into lottery segments in the circumferential direction; a medium introduction mechanism introducing the game medium individually into each lottery segment; an entrance unit detection device detecting a medium entrance unit into which the game medium has entered; a displacement amount detection device detecting an amount of displacement in the circum- (Continued)

ferential direction; and a lottery segment distinguishing device distinguishing from which of the lottery segments the game medium has entered into the medium entrance unit based on a result of detection by the displacement amount detection device.

12 Claims, 17 Drawing Sheets

(52) U.S. Cl.
CPC .... *G07F 17/329* (2013.01); *A63F 2009/2442* (2013.01)

(56) References Cited

U.S. PATENT DOCUMENTS 7,727,065 B2 * 6/2010 Seelig ..... G07F 17/3244 273/138.2
2009/0082086 A1 * 3/2009 Seelig ..... G07F 17/3213 463/20
2010/0210347 A1 * 8/2010 Seelig ..... G07F 17/3211 463/20
2011/0210510 A1 * 9/2011 Matsuki ..... G07C 15/001 273/144 A
2016/0180651 A1 * 6/2016 Hasegawa ..... A63F 5/02 463/17

OTHER PUBLICATIONS

Communication dated Aug. 23, 2017 from the Japanese Patent Office in counterpart Application No. 2016-028418.
Written Opinion dated Apr. 11, 2017 from the International Bureau in counterpart International Application No. PCT/JP2017/003999.
International Search Report dated Apr. 11, 2017 from the International Bureau in counterpart International Application No. PCT/JP2017/003999.

* cited by examiner

LOTTERY DEVICE AND GAME MACHINE USING SAME

This application is a Continuation of PCT/JP2017/003999, filed Feb. 3, 2017, which is a § 371 National Stage Application which claims priority to JP 2016-028418 filed Feb. 17, 2016, the disclosure of each is incorporated herein by reference.

BACKGROUND OF THE INVENTION

Field of the Invention

The present invention relates to a game machine equipped with a lottery device, etc.

Description of the Related Art

A game machine is per se known that provides with a plurality of satellite units that provide places for players to play at a game and a single physical lottery device that is shared between the satellite units, for example, a lottery device of a type in which a wheel on which a plurality of pockets are arranged in sequence around the circumferential direction and which serves as a drawing body is rotated in a horizontal plane, and a ball, which is one example of a game medium, is introduced around the external periphery of this wheel, so that a lottery is drawn according to which of the pockets the ball has fallen into (for example, refer to Patent Document #1).

CITATION LIST

Patent Literature

Patent Document #1: Japanese Laid-Open Patent Publication 2011-088019.

SUMMARY OF THE INVENTION

In such a prior art game machine, since a single physical lottery device is shared between a plurality of satellite units, accordingly it is not possible to perform a plurality of lotteries simultaneously in parallel, even if such a plurality of lotteries are required. Due to this there is the inconvenience that, for example, while a lottery for one player is being performed, the other players must wait for their own lotteries.

Accordingly, the object of the present invention is to provide a lottery device and a game machine employing such a lottery device, that are capable of simultaneously performing a plurality of lotteries in parallel.

A lottery device according to one aspect of the present invention comprises: a drawing body having a plurality of medium entrance units which are provided along a circumferential direction thereof, and into each of which a game medium is capable of entering; a driving mechanism that drives the drawing body in the circumferential direction; a dividing device that divides a periphery of a path of the plurality of medium entrance units of the drawing body, in which path the plurality of medium entrance units travel, into a plurality of lottery segments in the circumferential direction so that the game medium is unable to interchange between the lottery segments; a medium introduction mechanism that is provided so as to be capable of introducing the game medium individually into each of the plurality of lottery segments; an entrance unit detection device that detects a medium entrance unit into which the game medium has entered; a displacement amount detection device that detects an amount of displacement in the circumferential direction of the drawing body; and a lottery segment distinguishing device that distinguishes from which of the lottery segments, among the plurality of lottery segments, the game medium has entered into the medium entrance unit based on a result of detection by the displacement amount detection device.

And a game machine according to one aspect of the present invention comprises: a lottery device according to the aspect described above; a game control device that refers to a result of detection by the entrance detection device and to a result of distinguishing by the lottery segment distinguishing device, and that controls progression of a game for each of the plurality of lottery segments divided by the dividing device.

DESCRIPTION OF THE EMBODIMENTS

Figure 1:
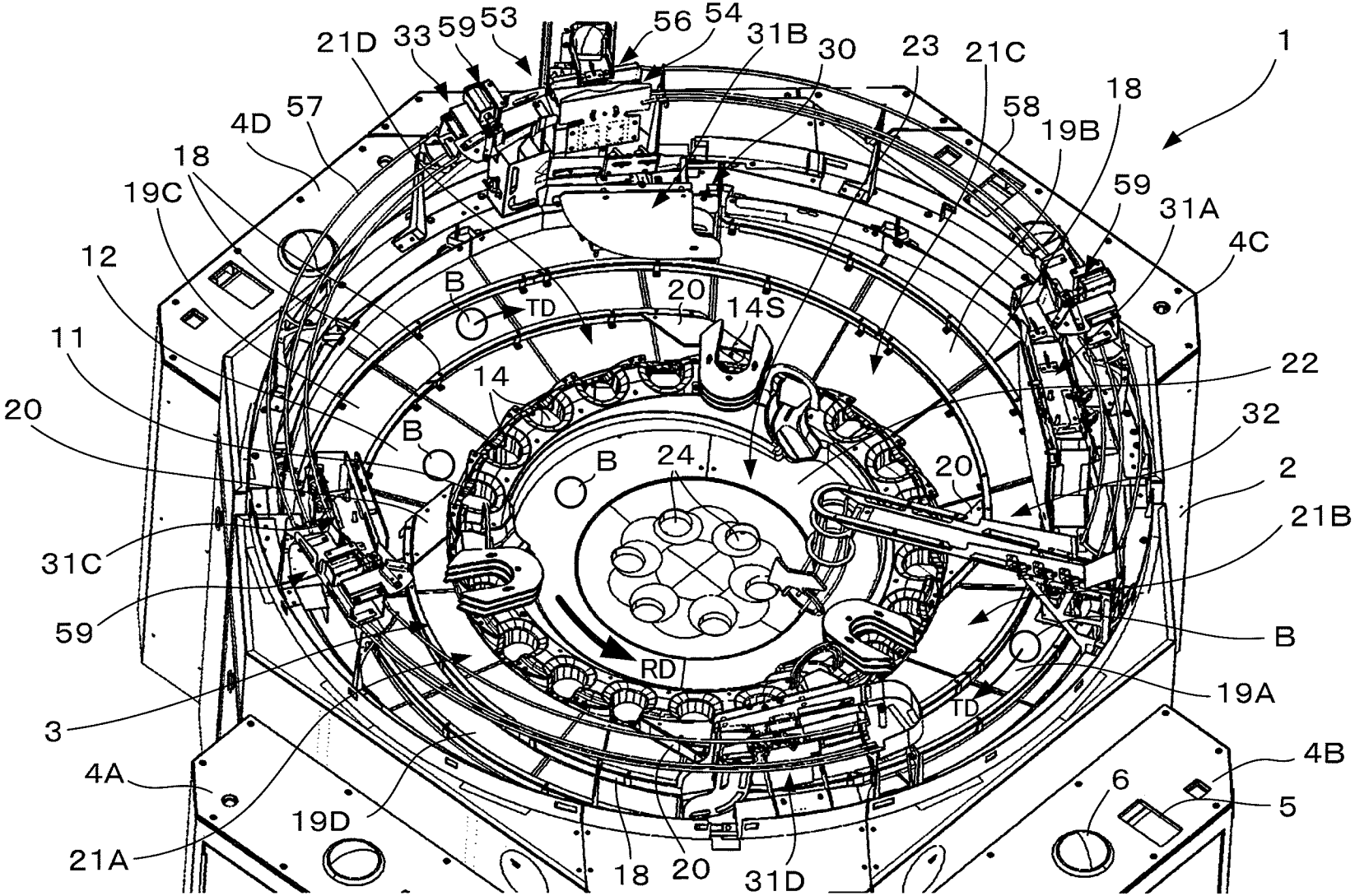
FIG. 1 is a perspective view showing an example of a game machine in which a lottery device according to an embodiment of the present invention is employed.
Figure 2:
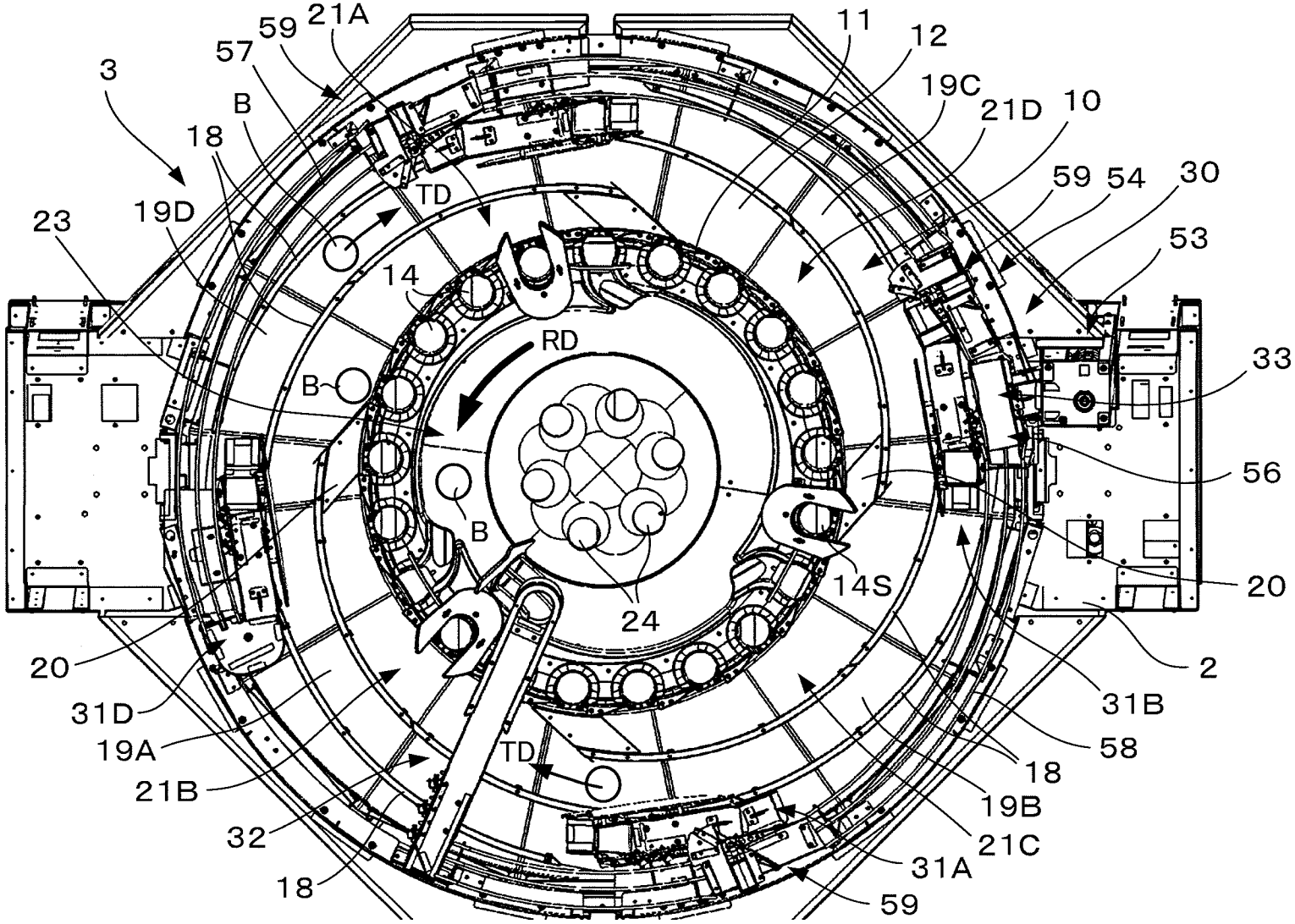
FIG. 2 is a plan view of the game machine of FIG. 1.

FIGS. 1 and 2 show an example of a game machine in which a lottery device according to an embodiment of the present invention is employed. As shown in these figures, the game machine 1 has a casing 2 that is generally shaped as polygonal (in one example, as an octagon) as seen from above, and a lottery device 3 that is provided in the central portion of the upper surface of the casing 2. A plurality (four in the figure) of stations 4A through 4D are arranged around the circumferential direction of the external periphery of the casing 2 at constant intervals. Each of these stations 4A through 4D is provided as a place for a player to perform operations related to the game. Each of the stations 4A through 4D is provided with an input unit 5 that is capable of taking in a medium such as a token or medal that symbolizes the value of a game or a coin that is actual currency, that must be consumed as a price for playing the game, a push button switch 6 that is a subject of operation by the player and a payment outlet (not shown in the figures) for paying out rewards to the player, and so on.

A lottery field 10 is provided to the lottery device 3. A lottery wheel 11, which is one example of a drawing body, is provided at the center portion of this lottery field 10, and a ball introduction surface 12 is provided around the external periphery of this lottery wheel 11. The lottery wheel 11 is driven to rotate in the direction of the arrow sign RD in the figure by a wheel drive mechanism 93 (refer to FIG. 11) that is disposed inside the casing 2. The ball introduction surface 12 is formed integrally with the casing 2, and this ball introduction surface 12 does not rotate, even though the lottery wheel 11 rotates. The ball introduction surface 12 is formed so as to slope gradually downward from the outer periphery towards the inner periphery of the lottery wheel. Furthermore, a ball introduction mechanism 30, which is one example of a medium introduction mechanism, is provided at the outer periphery of the lottery field 10. This ball introduction mechanism 30 is adapted to introduce balls B, which are one example of game media, selectively at a plurality of positions in the lottery field 10. The details of the ball introduction mechanism 30 will be described hereinafter.

The lottery wheel 11 can rotate around the axis of a vertical rotation shaft as a center, this shaft being set in a central position in the lottery field 10. A plurality of pockets 14, which are examples of the medium entrance units, are provided at fixed intervals around the circumferential direction of the outer periphery of the lottery wheel 11. Each of the pockets 14 opens toward the outside of the lottery wheel 11, and the width of an opening portion thereof is set to a size such that the ball B can pass through it. Furthermore, the pockets 14 are provided so as to penetrate through the lottery wheel 11 in the vertical direction. A ball B that has been introduced onto the ball introduction surface 12 enters from the outer periphery of the lottery wheel 11 into one of the pockets 14, and falls down to underneath the lottery wheel 11. This ball B that has fallen down from one of the pockets 14 is then retrieved by a retrieval unit that is provided inside the casing 2.

Attributes, which are options for the lottery, are set for the pockets 14 in an appropriate manner. These attributes may be distinguished by modes such as, for example, color, number, or design. For example, pockets that are shown in red color may be termed red pockets, pockets that are shown in blue color may be termed blue pockets, and so on. The attributes of each of the pockets 14 may be fixed or may be variable. Examples of attributes being made to be variable are, for example, that the color of light emitted by each pocket may be variable, or that a variable display unit may be provided to each of the pockets 14, with the contents of its display being capable of being changed. Some of the pockets 14 are made as special pockets 14S which have been adjusted so that entrance of a ball B thereinto is more difficult than it is for the other pockets. The special pockets 14S are equivalent to examples of the special entrance unit. While the number of special pockets 14S may be determined as appropriate, in the example shown in the figures, three of the pockets 14 are set as special pockets 14S.

Figure 3A:
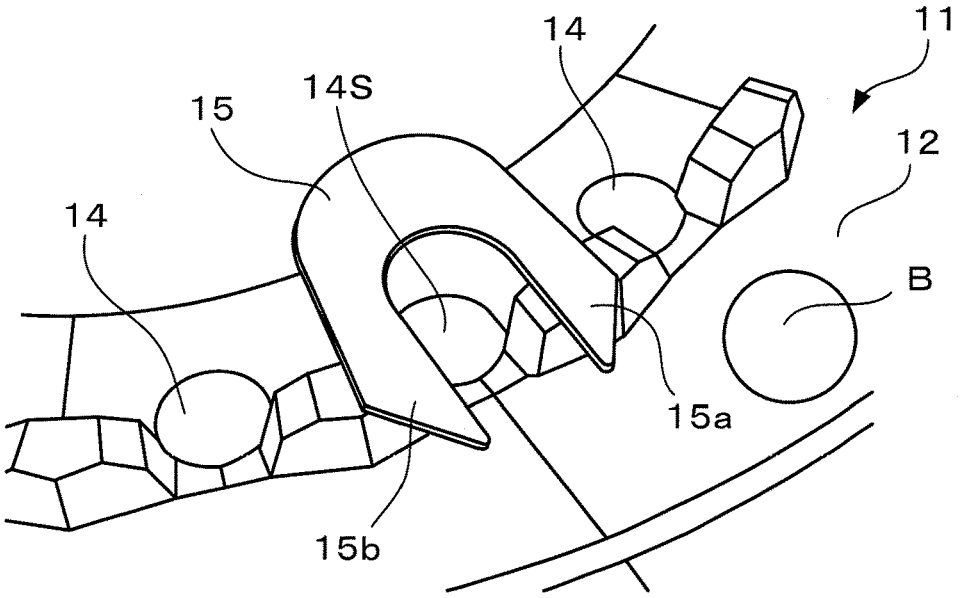
FIG. 3A is a figure showing an example of a special pocket in a lottery wheel.
Figure 3B:
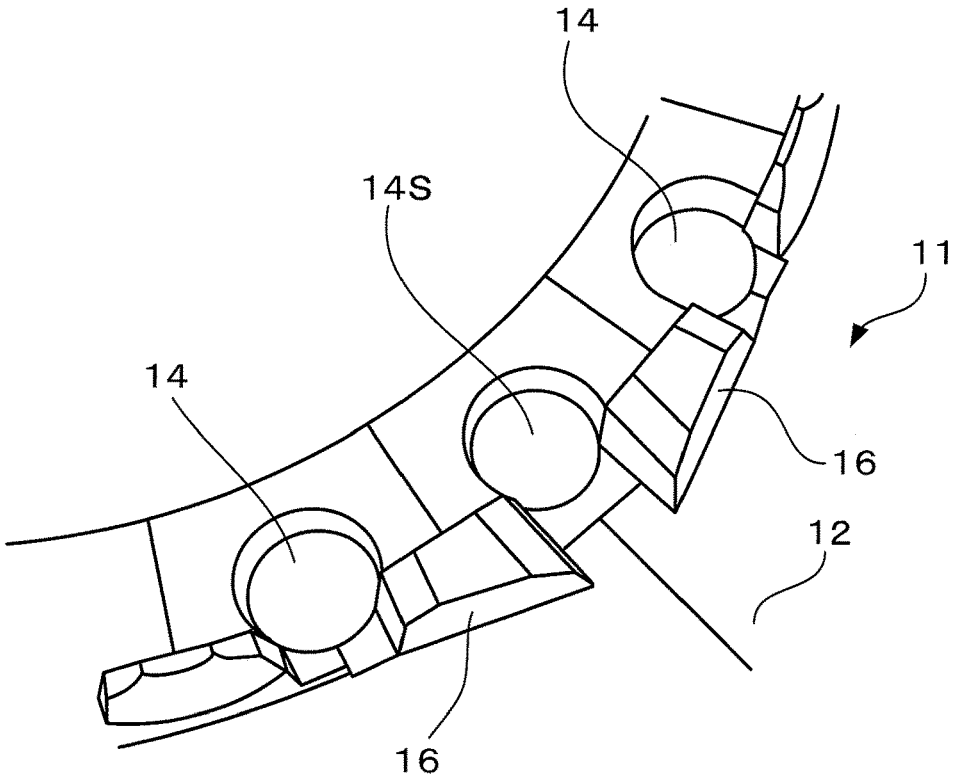
FIG. 3B is a figure showing another example of a special pocket in a lottery wheel.

As shown in FIG. 3A in enlarged view, a limitation plate 15 is attached on the upper surface side of each of the special pockets 14S, and has a pair of projecting portions 15*a* and 15*b* that project from both of the end portions of the special pocket 14*s* in the circumferential direction outward toward the outer peripheral side. When the lottery wheel 11 rotates, the projecting portions 15*a* and 15*b* act to push the ball B outward. Due to this, entrance of the ball B into the special pocket 14S is hindered to a moderate extent. It should be understood that the projecting portion 15*b* that is positioned toward the rear with respect to the direction of rotation of the lottery wheel 11 could also be provided so that its amount of projection is smaller than that of the projecting portion 15*a* that is positioned toward the front. The projecting portion 15*b* may also be omitted. As shown in FIG. 3B, instead of the limitation plate 15, it would also be possible to provide a pair of blocks 16 that project outward from both end portions toward the outer peripheral side of the special pocket 14S. It would also be acceptable to arrange further to enhance the operation for limiting the entrance of the ball B into the special pocket 14S by inclining the end surfaces of the blocks 16 on the outer peripheral sides so that they project more outward as approaching the opening portion of the special pocket 14S.

The pockets 14 other than the special pockets 14S are formed so as all to have the same shape and size, so that the probabilities of a ball B entering them are mutually equal. On the other hand, the attributes that are set for the pockets 14 may be adjusted so that the probabilities of a ball B entering them are made to be different for pockets having different attributes. For example, if the attributes are distinguished by color, then the attributes may be adjusted so that the numbers of pockets 14 for each color are different. Due to this, the probabilities of winning are made to be different between different attributes. The probability of a ball B entering into a special pocket 14S is set to be smaller, as compared to any probability of winning for each of the attributes set for the other pockets 14.

Returning to FIGS. 1 and 2, a plurality of guide rails 18 are provided upon the ball introduction surface 12 of the lottery field 10. The number of guide rails 18 is the same as the number of stations 4, i.e. four. Each of the guide rails 18 extends from the outer peripheral edge of the ball introduction surface 12 in the opposite direction with respect to the rotational direction of the lottery wheel 11, and is provided so as to gradually to approach the outer periphery of the lottery wheel 11 as approaching its tip end. To put this in another manner, the guide rails 18 are extended toward the center of the ball introduction surface 12, so that they describe spiral curves from the outer peripheral edge of the ball introduction surface 12 toward the opposite side to the rotational direction of the lottery wheel 11. The guide rails 18 are arranged at fixed intervals along the circumferential direction of the ball introduction surface 12. Moreover, the gap between two of the guide rails 18 that are adjacent in the radial direction of the ball introduction surface 12 is set to a level such that a ball B can pass between them. Due to this, four guidance paths 19A through 19D are defined that extend around the outer periphery of the ball introduction surface 12 along the circumferential direction of the lottery wheel and describe spiral shapes.

Furthermore, a block 20 is provided at the end portion of each of the guide rails 18, in other words at its end portion on the internal circumferential side. These blocks 20 are provided so as to fill the entire gap generated between the tip end portion of each guide rail 18 and the outer periphery of the lottery wheel 11. The guide rails 18 and the blocks 20 project to such a height that the balls B cannot ride over them up from the ball introduction surface 12. Due to this, the region upon the ball introduction surface 12 around the edge of the track where the pockets 14 circulate is divided into a plurality (in the figure, four) lottery segments 21A through 21D between which the balls B cannot interchange. Accordingly, the guide rails 18 and the blocks 20 function as one example of a dividing device that partitions the outer periphery of the lottery wheel 11 into the four lottery segments 21A through 21D. The lottery segment 21A is connected to the guidance path 19A, the lottery segment 21B is connected to the guidance path 19B, the lottery segment 21C is connected to the guidance path 19C, and the lottery segment 21D is connected to the guidance path 19D. In other words, the lottery segments 21A through 21D are alternately connected to the guidance paths 19A through 19D.

The number of stations 4A through 4D and the number of lottery segments 21A through 21D are the same, and a one-to-one correspondence relationship is established between them. For example, the station 4A may correspond to the lottery segment 21A that is positioned in front of this station 4A, as seen from the point of view of the player. In a similar manner, the guidance path 19A also has a correspondence relationship with respect to the station 4A. In the following, it will be supposed that the suffixes A through D in the reference symbols for the stations 4A through 4D, the guidance paths 19A through 19D, and the lottery segments 21A through 21D represent groups of structural elements that are mutually associated. Furthermore, when it is not necessary to distinguish between these structural elements, in some cases they will be referred to by reference symbols in which the suffixes are omitted, as for example "the station 4". And, in relation to other structural elements explained in the following as well, the suffixes A through D will be employed when explicitly referring to their relationship with the stations 4A through 4D, while, when there is no requirement to distinguish them in this way, in some cases those elements will be referred to by reference symbols in which the suffixes A through D are omitted.

As described above, in this lottery device 3, each of the four lottery segments 21 is separated from the others so that mutual transfer of balls B between them is not possible. Additionally, a one-to-one relationship is established between the lottery segments 21 and the stations 4. Accordingly, while, in the single lottery segment 21 that corresponds to one of the stations 4, a lottery is being performed by determining into which of the pockets 14 a ball B is entering, it is still possible for lotteries to be performed concurrently in the other lottery segments 21 by introducing balls B simultaneously thereinto. However, in order to conduct simultaneous lotteries in parallel, it is necessary for it to be possible to introduce balls B individually into each of the lottery segments 21. This feature is implemented via a ball introduction mechanism 30 that will be described hereinafter. Furthermore, in the lottery device 3, the lottery wheel 11 is shared between the four lottery segments 21, and the lottery wheel 11 is rotationally driven so that the pockets 14 pass sequentially through the four lottery segments 21. Accordingly, when a ball B enters into any one of the pockets 14, it is necessary to distinguish in which lottery segment 21 that ball B entered that pocket 14. The means for implementing such a function will also be described hereinafter.

A region upon the ball introduction surface 12 on the outer periphery side of the lottery wheel 11 can cover a comparatively long distance in the circumferential direction, and moreover can cover a corresponding space in the radial direction of the lottery wheel 11. Accordingly, even though the region upon the ball introduction surface 12 is divided into the plurality of lottery segments 21A through 21D, still it is possible to allocate a comparatively large space to each of the lottery sections 21. In a case in which each of the lottery segments 21 is narrow, since the possibility that the ball B may enter into a pocket 14 at an early stage is enhanced, accordingly, if the ball B is introduced with well-calculated timing, it becomes possible to make the ball B enter into the pocket 14 that is the objective comparatively easily, so that the possibility that the skill of the player may influence the result of the lottery is enhanced. However, since it is possible to allocate a comparatively large space to each of the lottery segments 21 in this lottery device 3, accordingly it is possible to endow the ball B and the lottery wheel 11 with sufficient relative motion in each of the lottery segments 21, and thereby it is possible to increase the difficulty of forecasting the lottery result, and to restrict the margin for the skill of the player to intervene. Furthermore, the ball B is introduced into the lottery segment 21 so as to travel along the outer periphery of the lottery segment 21, and moreover the direction in which it is introduced is set to be opposite to the direction of rotation of the lottery wheel 11. Due to this it is possible to endow the ball B with sufficient motion, and, after the ball B has been introduced, it is possible to increase the length of time until it enters into one of the pockets 14. Yet further, since the guidance path 19 is extended in the shape of a spiral, accordingly it is possible to lengthen the approach section until the ball B is introduced into the lottery segment 21, and, along with the ball B being given sufficient speed because of this, also it is possible to increase the difficulty of judging the timing for introducing the ball B so that it will enter into the desired pocket 14. As a result, it is possible further to reduce the ease of forecasting the result of the lottery, so that it is possible to reduce the margin that can be intervened by the skill of the player by yet a further level.

A ball introduction surface 22 is formed on an inner circumferential side of the lottery wheel 11, and a lottery segment 23 that includes this ball introduction surface 22 is further provided at the center portion of the lottery wheel 11, this section 23 being different from the lottery segments 21 on the outer circumferential side of the lottery wheel. The ball introduction surface 22 is integral with the lottery wheel 11, and rotates together with the rotational driving of the lottery wheel 11. In the following description, sometimes the lottery segments 21 and the lottery segment 23 will be mutually distinguished by terming the lottery segments 21 the "outer lottery segments 21" and by terming the lottery segment 23 the "inner lottery segment 23". The height of the ball insertion surface 22 is determined as being sufficiently lower than the outer peripheral portion of the lottery wheel 11, in other words than the region in which the pockets 14 are formed. Due to this, it is made impossible for a ball B to interchange between the outer lottery segments 21 and the inner lottery segment 23. It should be understood that the inner lottery segment 23 is not divided into individual portions for each of the stations 4A through 4D, but rather is provided as a lottery segment that is used in common between the stations 4A through 4D. Additionally, a plurality (six in the example shown in the figure) of pockets 24, which are examples of the medium entrance unit, are provided in the inner lottery segment 23, spaced at equal intervals around the circumferential direction. These pockets 24 are provided so as to pierce through the lottery wheel 11 in the vertical direction. A ball B that has passed through one of the pockets 24 is retrieved by the retrieval unit inside the casing 2, in a similar manner to the case for a ball B that has passed through one of the pockets 14. Attributes that serve as lottery options are also set in an appropriate manner for each of the pockets 24 as well. The attributes of each of the pockets 24 may be unchanging or may be variable. In the following, the explanation will be continued under the assumption that the attributes of the pockets 24 can be changed.

Figure 4:
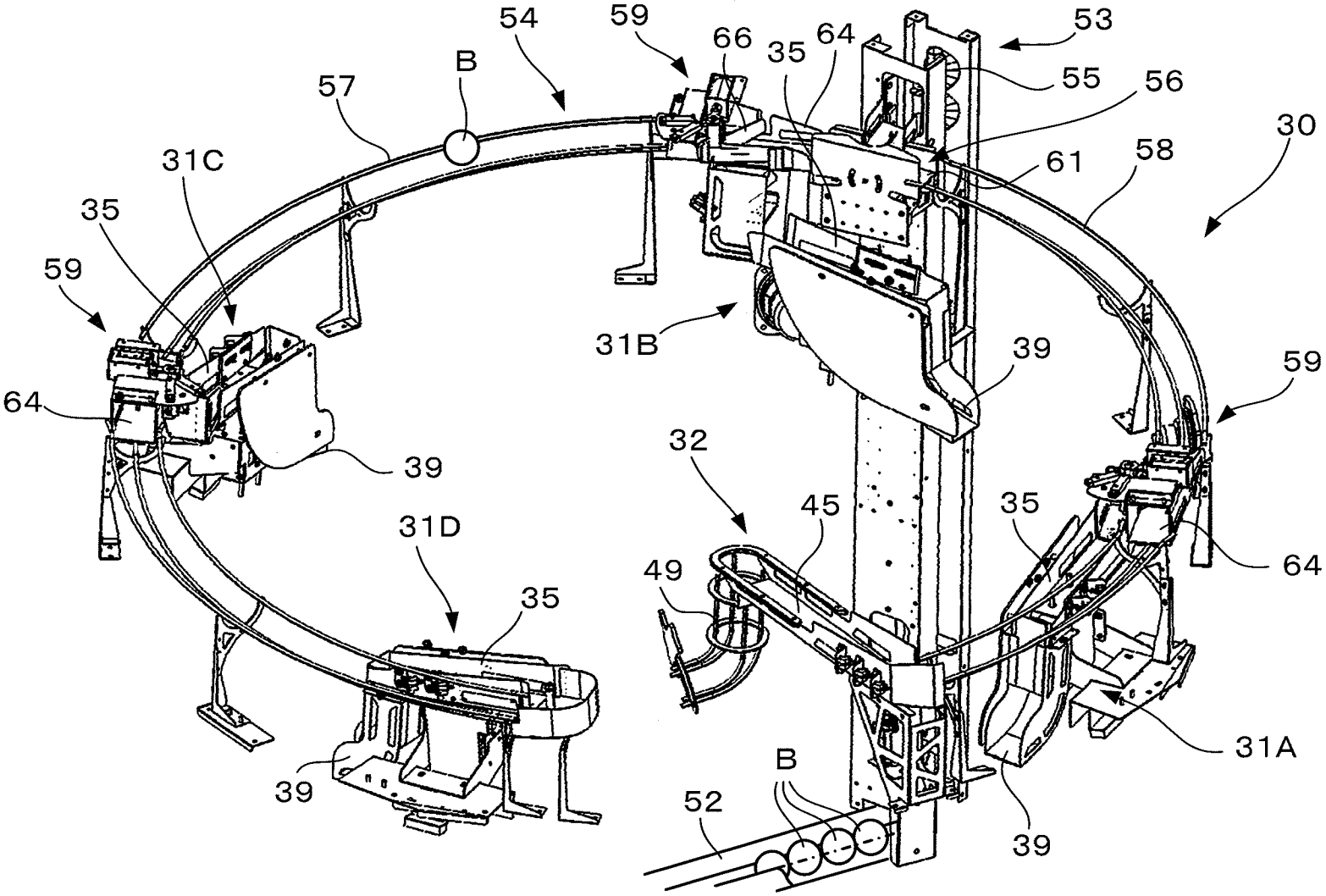
FIG. 4 is a perspective view of a ball introduction mechanism.

As shown in FIGS. 1 and 4, a ball introduction mechanism 30 is provided, and is adapted to be capable of introducing balls B individually at each of the lottery segments 21 and 23. That is, the ball introduction mechanism 30 includes individual introduction mechanisms 31A through 31D that introduce balls B individually at the outer lottery segments 21A through 21D respectively, and a center introduction mechanism 32 that introduces balls B at the inner lottery segment 23. Each of the individual introduction mechanisms 31A through 31D and the center introduction mechanism 32 functions as an example of the unit introduction mechanism of this lottery device. Furthermore, a ball supply mechanism 33, which is one example of a medium supply mechanism, is also provided to the ball introduction mechanism 30 for selectively supplying balls B that have previously been retrieved inside the casing 2 to the individual introduction mechanisms 31 and to the center introduction mechanism 32. The individual introduction mechanisms 31 are provided so as to match the outer peripheral end portions of the guidance paths 19 that are defined by the guide rails 18, and so as also to match the positions thereof in the circumferential direction. In other words, the individual introduction mechanisms 31 are provided so as to supply balls B to the outer peripheral end portion of any one of the guidance paths 19.

Figure 5:
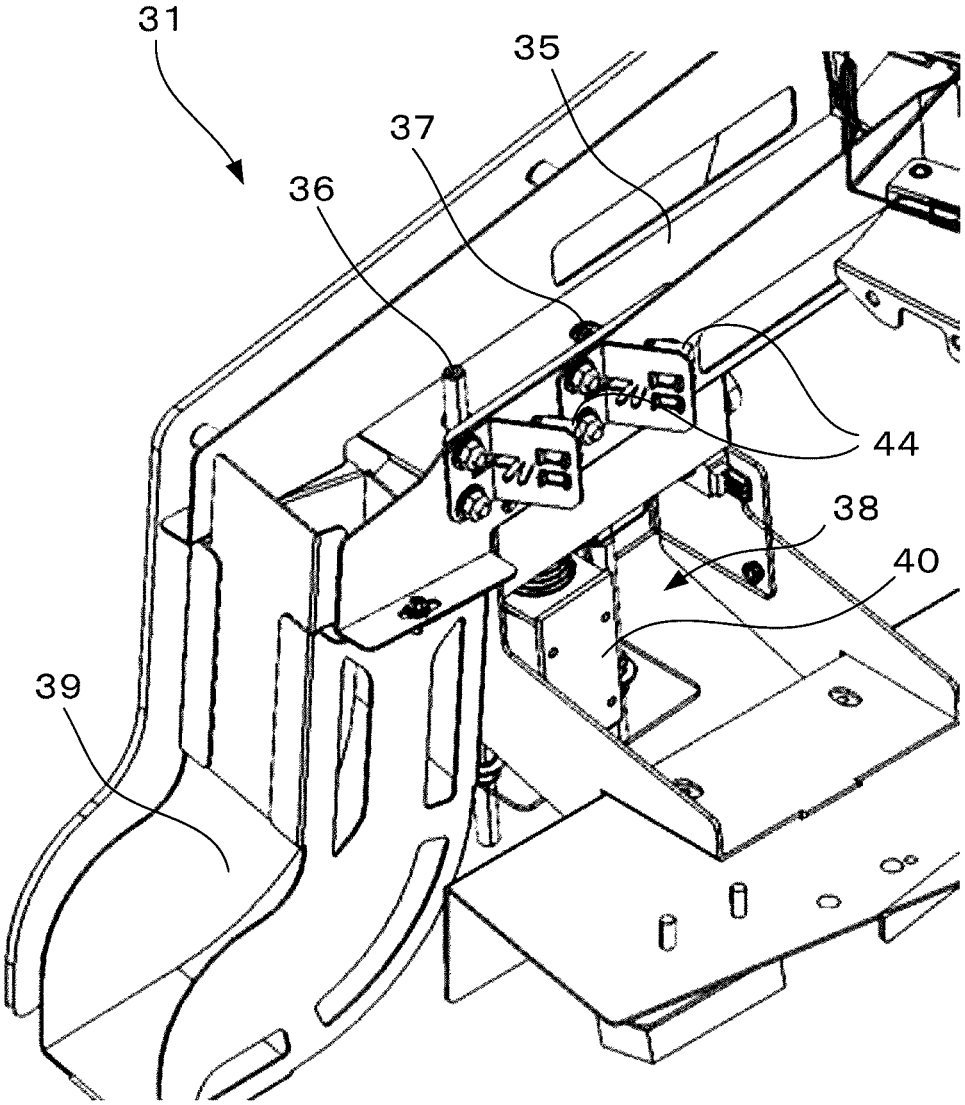
FIG. 5 is a perspective view of an individual introduction mechanism that corresponds to one outer lottery segment.

FIG. 5 shows the details of one of the individual introduction mechanisms 31. It should be understood that the structures of the four individual introduction mechanisms 31 are the same. This individual introduction mechanism 31 has a ball guide 35 that is formed like a trough and which is one example of an individual holding portion that is capable of holding a plurality of balls B in a state of being arranged in a row, a pair of pin shaped stoppers 36 and 37 that are arranged with a gap between them in the longitudinal direction of the ball guide 35 in states in which they are capable of being projected from the bottom surface of the ball guide 35, and a stopper drive unit 38 that drives these stoppers 36 and 37 between positions in which they are projected into the ball guide 35 and positions in which they are retracted below the ball guide 35. The ball guide 35 is attached to the outer peripheral portion of the casing 2, so that its longitudinal direction generally follows the circumferential direction of the ball introduction surface 12. The ball guide 35 is inclined. This inclination is determined so that its front portion is higher with respect to the direction of rotation of the lottery wheel 11, while its rear portion is lower. In other words, the ball guide 35 is provided so as to be inclined with a downward gradient in the direction opposite to the direction of rotation of the lottery wheel 11. In the following, the lower side of the ball guide 35 will be termed its front end side, while its higher side will be termed its rear end side.

A chute 39 is provided on the front end side of the ball guide 35. The lower end portion of this chute 39 is connected to the end portion of the guidance path 19. Accordingly, it is possible to guide a ball B from the front end side of the ball guide 35 via the chute 39 to the guidance path 19. A ball B that has fallen down from the chute 39 is introduced into the lottery segment 21 via the guidance path 19. As shown by the arrow sign TD in FIGS. 1 and 2, the direction of this introduction is along the outer periphery of the lottery wheel 11, and moreover is opposite to the direction of rotation of the lottery wheel 11. Accordingly, the guidance path 19 functions as a part of the individual introduction mechanism 31, and, in the ball introduction mechanism 30, the guide rail 18 that defines the guidance path 19 functions as an example of the guidance device.

The stoppers 36 and 37 and the stopper drive unit 38 are provided in order to change over between introducing a ball B from the ball guide 35, and stopping the introducing. The stopper 36 on the front end side of the ball guide 35 prevents the ball B from shifting toward the chute 39 by protruding into the ball guide 35, and permits the ball B to fall down by retreating from the ball guide 35. The distance between the stoppers 36 and 37 is set to be approximately equal to the diameter of a single one of the balls B.

Figure 6:
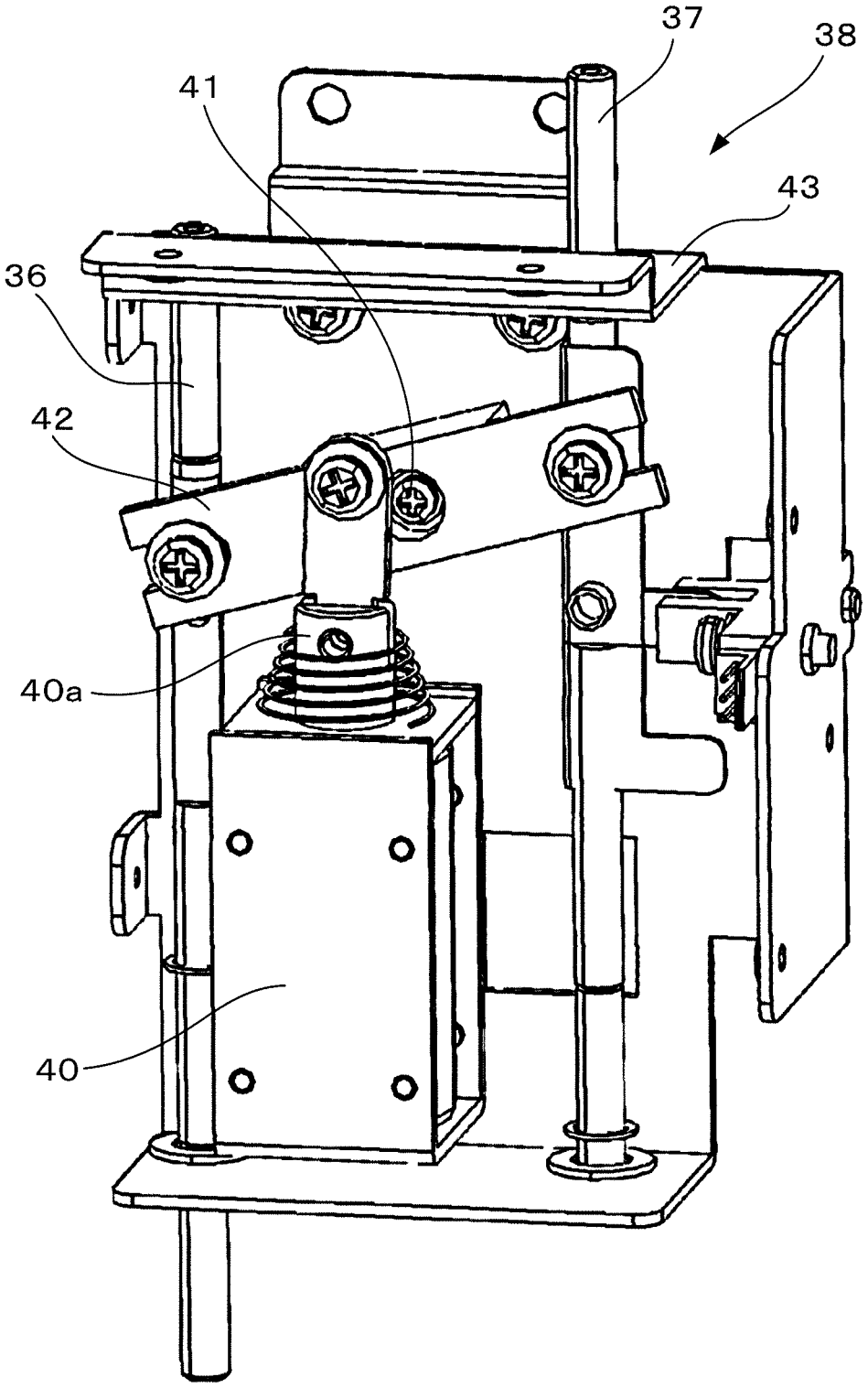
FIG. 6 is a perspective view of a stopper drive unit that is provided to this individual introduction mechanism.

The stopper drive unit 38 alternatingly protrudes into the ball guide 35 and retracts therefrom, in such a manner that when one of the stoppers 36 and 37 is projected the other one is withdrawn. As shown in FIG. 6, the stopper drive unit 38 has an electromagnetic actuator 40 that serves as a drive source for driving the stoppers 36 and 37, a link 42 that is provided so as to be capable of swinging around a support shaft 41 as center above this electromagnetic actuator 40, and a guide 43 above the link 42 that guides the stoppers 36 and 37 so that each of them shifts along the direction of its axial line. The stopper 36 is linked to one end portion of the link 42 so as to be rotatable with respect thereto, and the stopper 37 is linked to the other end portion of the link 42 so as to be rotatable with respect thereto. The electromagnetic actuator 40 is a direct-acting type actuator in which a rod 40*a* is shifted to advance and retract in the vertical direction in response to changing over of the supply of electricity, and the upper end portion of the rod 40*a* is linked to the link 42 at a position that is somewhat removed from the support shaft 41, so as to be rotatable with respect thereto. Accordingly, along with the advancing and retracting operation of the rod 40*a* of the electromagnetic actuator 40, the stoppers 36 and 37 are driven so that one of them is retracted when the other is protruded. In the example shown in FIG. 6, the stopper 36 is lowered and the stopper 37 is raised when the rod 40*a* is retracted downward, while the stopper 36 is raised and the stopper 37 is lowered when the rod 40*a* is projected upward. However, it would also be acceptable to set the relationship of correspondence between the advancing and retracting operation of the rod 40*a* and raising and lowering of the stoppers 36 and 37 to be opposite to that shown in the illustrated example.

In the individual introduction mechanism 31 described above, when the stopper 36 on the front end side is retracted and the stopper 37 on the rear end side is projected, a ball B that is positioned at the front end of the ball guide 35 (i.e. at the most front end side) falls down into the chute 39, and a rearward ball B contacts the stopper 37 but is not able to move further toward the chute 39. After one ball B has passed the position of the stopper 36, by projecting the stopper 36 and retracting the stopper 37, it is possible to allow the next ball B to move onward to the position where it contacts the stopper 36. By repeating the above operations, this individual introduction mechanism 31 is able to introduce one ball B at a time onto the lottery segment 21.

A plurality (in the example shown in the figures, two) of ball sensors 44 for detecting the presence or absence of balls B in the ball guide 35 are provided to the individual introduction mechanism 31 described above. The ball sensors 44 are provided so as to detect one ball B that is contacted against and held by the stopper 36, and one subsequent ball B following the first ball B. Accordingly, by referring to the detection signals from those ball sensors 44, it is possible to determine the number of balls B held within the ball guide 35 (hereinafter this is sometimes referred to as the "stocked number"), within the range of two balls or fewer. However, it would also be acceptable, by providing three or more of the ball sensors 44, to arrange to make it possible to determine whether or not the number of balls B stored is within any range of three balls or more.

Figure 7:
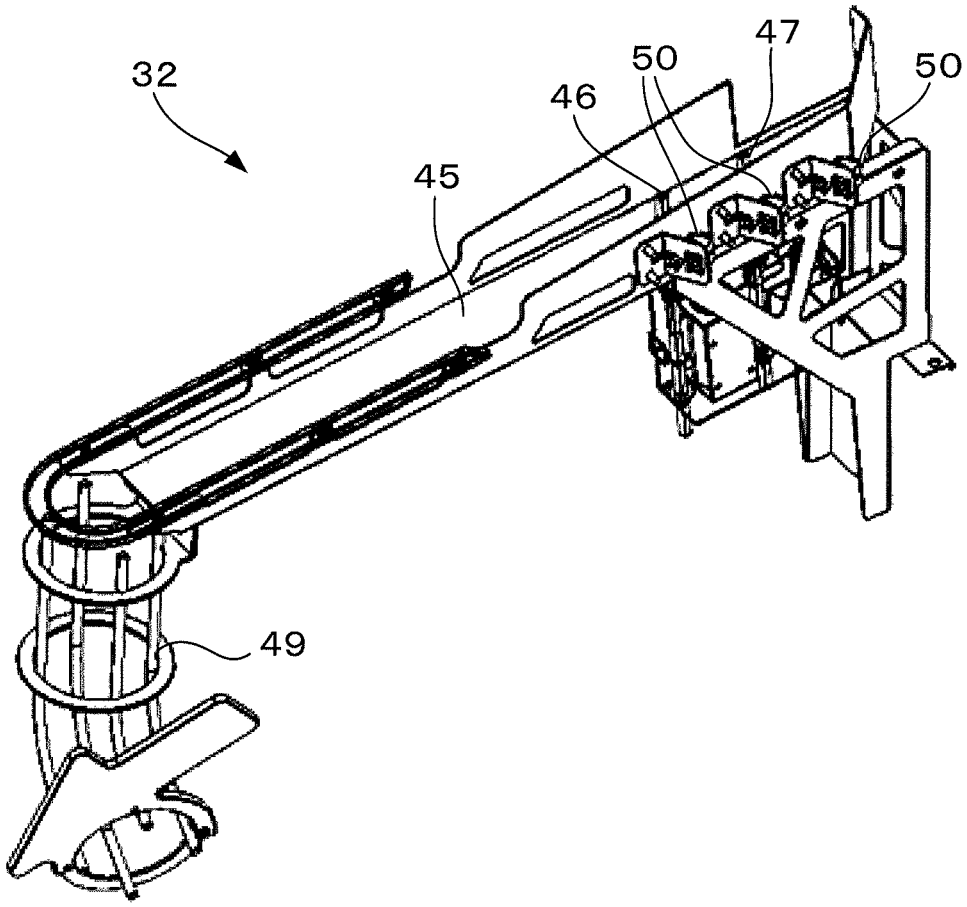
FIG. 7 is a perspective view of a center introduction mechanism that corresponds to an inner lottery segment.

FIG. 7 shows the details of the center introduction mechanism 32. This center introduction mechanism 32 has a ball guide 45 formed like a trough, which is one example of the individual holding portion, and that is capable of receiving a plurality of balls B in the state of being lined up in a row, a pair of pin shaped stoppers 46 and 47 that are arranged along the longitudinal direction of the ball guide 45 with a certain gap between them and that can be protruded from and retracted into the bottom surface of the ball guide 45, and a stopper drive unit 48 that drives the stoppers 46 and 47 between positions in which they protrude into the ball guide 45 and positions in which they are retracted to below the ball guide 45. The ball guide 45 is attached to the outer peripheral portion of the casing 2 so as to reach to the space above the ball introduction surface 22 of the inner lottery segment 23 from the outer peripheral portion of the casing 2. The ball guide 45 is inclined so as to have a downward gradient toward the central portion of the casing 2. A chute 49 is provided at the end of the ball guide 45. This chute 49 extends substantially downward from the tip end portion of the ball guide 45, and its lower end portion is a little curved toward the side opposite to the rotational direction of the lottery wheel 11. Accordingly, the ball B is introduced from the chute 49 onto the ball introduction surface 22 so as to follow the outer periphery of the lottery segment 23, and moreover so as to advance in the direction opposite to the direction of rotation of the lottery wheel 11.

The stoppers 46 and 47 and the stopper drive unit 48 are provided in order to change over between introduction of a ball B from the ball guide 45, and stopping such introduction. The stoppers 46 and 47 are provided along the longitudinal direction of the ball guide 45, spaced apart by a gap that is almost equal to the diameter of a single ball B. The stopper drive unit 48 alternatingly causes the stoppers 46 and 47 to protrude into the ball guide 45 and to retract therefrom, in a similar manner to the case with the stopper drive units 38 in the individual introduction mechanisms 31. Thus, it is possible for the center introduction mechanism 32 to introduce one ball B at a time by making the stoppers 46 and 47 alternatingly protrude and retract. Since the structure of the stopper drive unit 48 is the same as that of the stopper drive units 38, accordingly detailed explanation thereof will be omitted. However, in the individual introduction mechanisms 31, the stoppers 36 and 37 are provided on the front end side of the ball guides 35, whereas by contrast, in the center introduction mechanism 32, the stoppers 46 and 47 are provided at a position that is comparatively close to the rear end of the ball guide 45. Since, in the individual introduction mechanisms 31, the guidance paths 19 are interposed between the stoppers 36 and the lottery segments 21, accordingly the distances through which the balls B shift from the ball guides 35 to the outer lottery segments 21 are set to be comparatively long, and it is possible for the balls B to be sufficiently accelerated. By contrast, in the inner lottery segment 23, no such guidance path is present, and moreover the length of the ball introduction surface 22 in the circumferential direction is also short. Due to this, the distance through which the ball B shifts is increased by bringing the position in the ball guide 45 where introducing of the ball B starts, in other words the position where the ball B is held by the stopper 46, close to the rear end of the ball guide 45.

It should be understood that a plurality (in the example shown in the figures, three) of ball sensors 50 for detecting the presence or absence of balls B in the ball guide 45 are also provided to the center introduction mechanism 32. These ball sensors 50 are provided so as to detect the one ball B that is contacted against and held by the stopper 46, and two subsequent balls B following the first ball B. Accordingly, by referring to the detection signals from those ball sensors 50, it is possible to determine the stocked number of balls B within the ball guide 45, within the range of three balls or fewer.

Returning to FIG. 4, the ball supply mechanism 33 has a lifter mechanism 53 that extracts one ball at a time from a ball guide 52 inside the casing 2 and conveys it upward, and a ball distribution mechanism 54 that selectively distributes balls B conveyed by the lifter mechanism 53 either to any one of the individual introduction mechanisms 31A through 31D or to the center introduction mechanism 32. The ball guide 52 is adapted to keep balls B in a state of being lined up in a row, and functions as an example of the medium reservoir unit. The balls B that fall down from the pockets 14 and 24 and that are retrieved by the retrieval unit within the casing 2 are conveyed out to the ball guide 52 by an arrangement mechanism (not shown in the figures) within the casing 2, and are stored in the guide 52 as lined up in a row. The lifter mechanism 53 takes out balls B from the ball guide 52 one ball at a time, for example by rotation of a screw conveyor 55, conveys them to a position somewhat higher than the lottery field 10 of the casing 2, and then discharges the balls B that have thus been conveyed to the ball distribution mechanism 54.

The ball distribution mechanism 54 has a primary allocation unit 56 that is provided so as to be adjacent to the position where the balls B are discharged from the lifter mechanism 53, a first ball guide 57 that extends from the primary allocation unit 56 sequentially via the individual introduction mechanisms 31B and 31C to the individual introduction mechanism 31D so as to describe an arc along the outer periphery of the casing 2, a second ball guide 58 that extends from the primary allocation unit 56 via the individual introduction mechanism 31A to the center introduction mechanism 32 so as to describe another arc along the outer periphery of the casing 2, and secondary allocation units 59 that are provided at each of the connection positions between the first ball guide 57 and the individual introduction mechanisms 31B and 31C and at a connection position between the second ball guide 58 and the individual introduction mechanism 31A. Each of the first and second ball guides 57 and 58 is attached to the casing 2 in such a way as to slope so as to become gradually lower as going away from the primary allocation unit 56.

Figure 8:
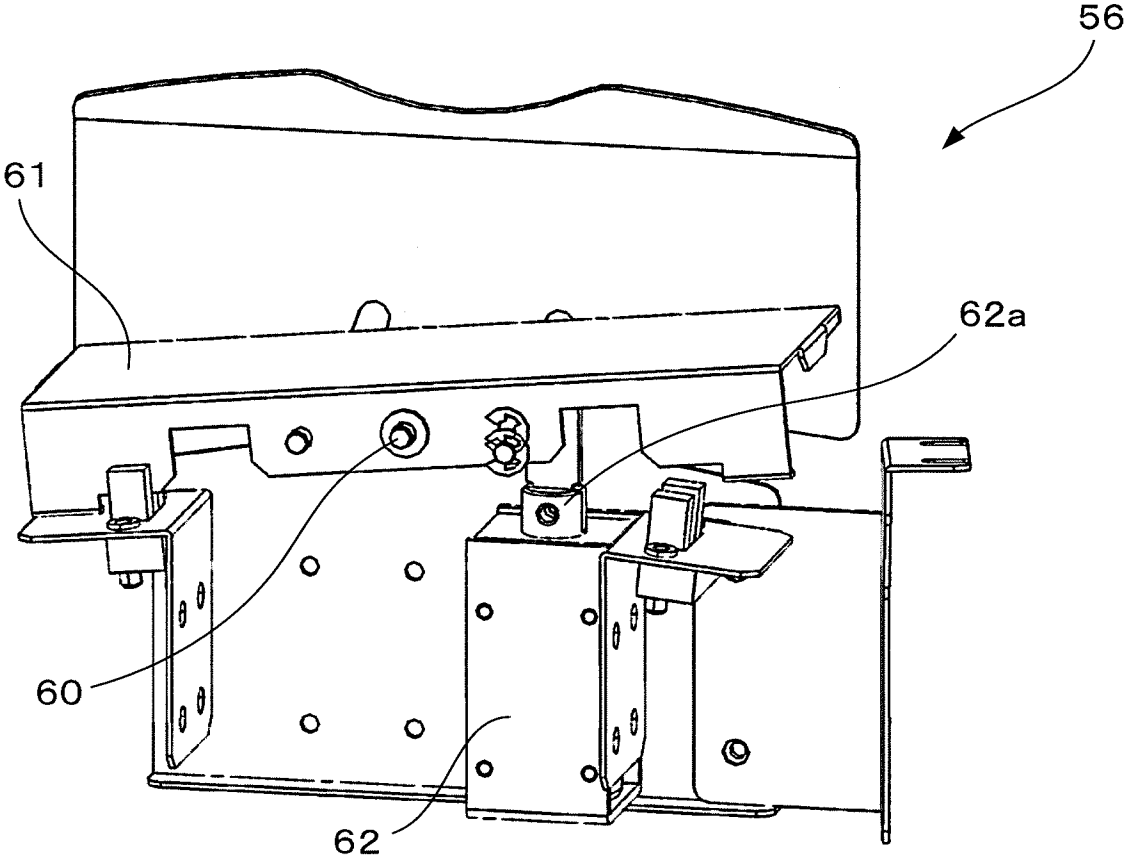
FIG. 8 is a perspective view of a primary allocation unit of the ball supply mechanism.

As shown in FIG. 8, the primary allocation unit 56 has a selector 61 that is capable of tilting around a support shaft 60 as a center, and a linear motion type electromagnetic actuator 62 that serves as a source of drive power for driving the selector 61 to tilt around the support shaft 60. The rod 62*a* of the electromagnetic actuator 62 is linked to the selector 61 at a position somewhat removed from the support shaft 60, so as to be rotatable with respect thereto. Accordingly, along with the projection and retraction operation of the rod 62*a* of the electromagnetic actuator 62, the selector 61 is driven to rotate around the support shaft 60. The support shaft 60 is provided at a position directly underneath the position where the balls B are discharged from the lifter mechanism 53. Additionally, the selector 61 is arranged so that its two end portions are adjacent to the end portions of the first ball guide 57 and of the second ball guide 58 respectively. When one or the other of the end portions of the selector 61 is displaced downward, then its other end portion is positioned at almost the same height as the end portion of the first ball guide 57 or the second ball guide 58 that is adjacent thereto. Accordingly, by selecting the direction of tilting of the selector 61 by the electromagnetic actuator 62, it is possible to conduct a ball B that has been discharged from the lifter mechanism 53 selectively either to the first ball guide 57 or the second ball guide 58.

Figure 9:
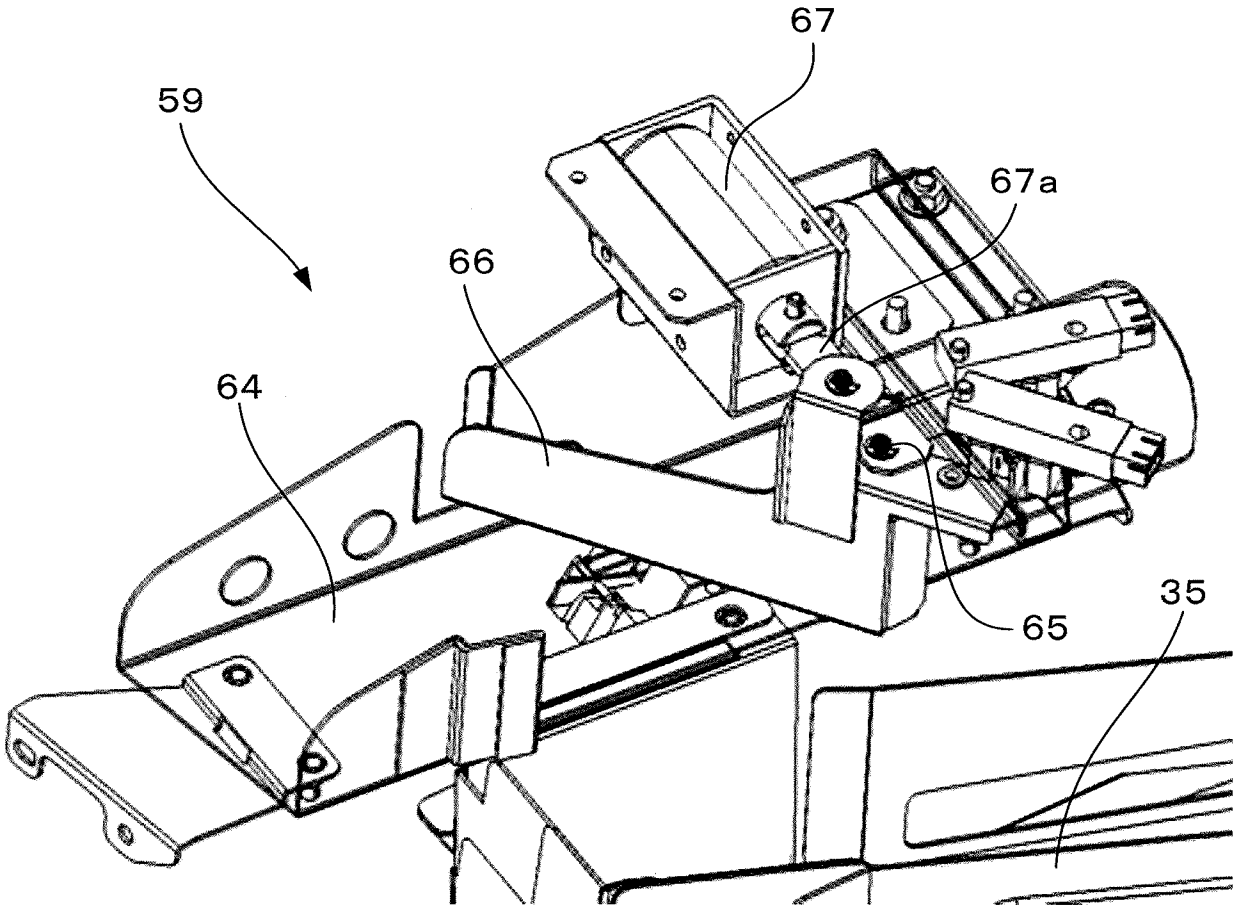
FIG. 9 is a perspective view of a secondary allocation unit of the ball supply mechanism.

FIG. 9 shows details of one of the secondary allocation units 59. It should be understood that all of the three secondary allocation units 59 in the three locations have the same structure. This secondary sorting unit 59 has a ball guide 64 that is provided so as to permit balls B to pass through it, a gate 66 that is attached to the ball guide 64 so as to be capable of rotating about a support shaft 65 as a center, and an electromagnetic actuator 67 of a linear motion type that serves as a source of drive power for rotationally driving the gate 66 to turn around its support shaft 65. This ball guide 64 is provided so as to constitute a portion of the first ball guide 57 or the second ball guide 58. The rod 67*a* of the electromagnetic actuator 67 is connected to the gate 66 at a position somewhat removed from the support shaft 65, so as to rotate freely with respect thereto. Accordingly, along with the projection and retraction operation of the electromagnetic actuator 67, the gate 66 is rotated between a position (the position shown in the figure) in which it is obtruded into the ball guide 64, and a position in which it is retracted from the ball guide 64.

When the gate 66 is obtruded into the ball guide 64, then the ball guide 64 is obstructed part way therealong. As a result, a ball B that is being guided from the primary allocation unit 56 (which is on the left side of FIG. 9) is further guided by the gate 66 and is diverted from the ball guide 64. At the position of the gate 66, the rear end portion of the ball guide 35 of one of the individual introduction mechanisms 31 is disposed adjacent thereto. Accordingly, a ball B that has been diverted from the ball guide 64 is transferred to the rear end portion of that ball guide 35. On the other hand, when the gate 66 is retracted from the ball guide 64, then a ball B that is being guided from the primary allocation unit 56 passes the ball guide 64 and continues onward away from this secondary allocation unit 59.

According to the ball distribution mechanism 54 described above, by combining the position of the selector 61 of the primary allocation unit 56 and the positions of the gate 66 of each of the secondary allocation units 59 in an appropriate manner, it is possible to supply a ball B selectively either to any one of the individual introduction mechanisms 31 or to the center introduction mechanism 32. For example, when the selector 61 is angled so that the ball B is guided to the first ball guide 57, then it is possible to conduct the ball B to any desired one of the individual introduction mechanisms 31B, 31C, or 31D alternatively by selecting the positions of the gates 66 of the secondary allocation units 59 that lie upon this first ball guide 57 in an appropriate manner. On the other hand, when the selector 61 is angled so that the ball B is guided to the second ball guide 58, then it is possible to conduct the ball B either to the individual introduction mechanism 31A or to the center introduction mechanism 32, alternatively, depending upon the position of the gate 66 of the secondary allocation unit 59 upon this second ball guide 58.

Figure 10A:
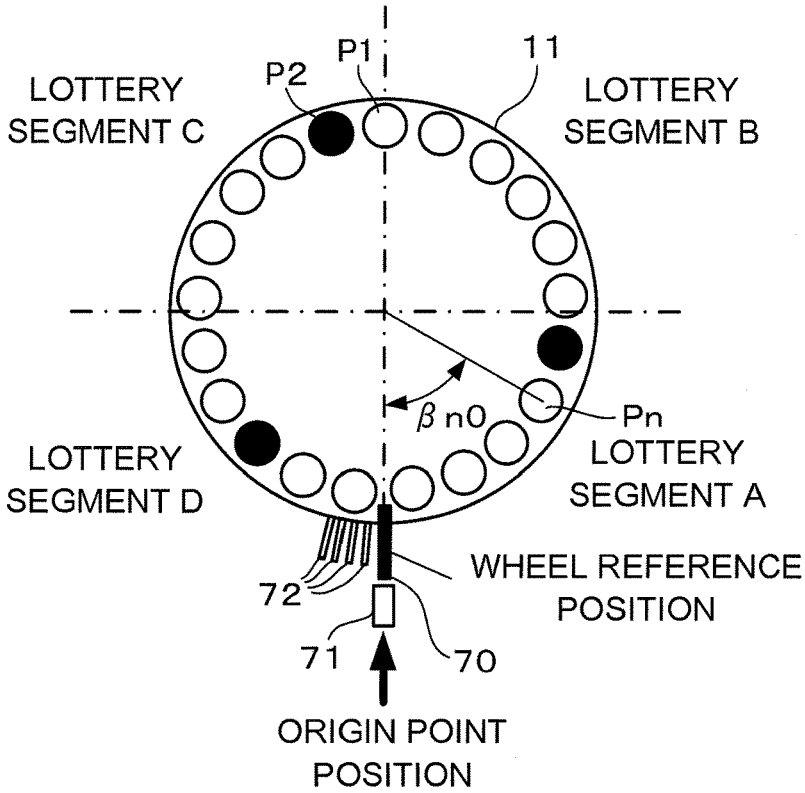
FIG. 10A is a figure for explanation of a technique for determining which is the lottery segment from which a ball has entered into a pocket.
Figure 10B:
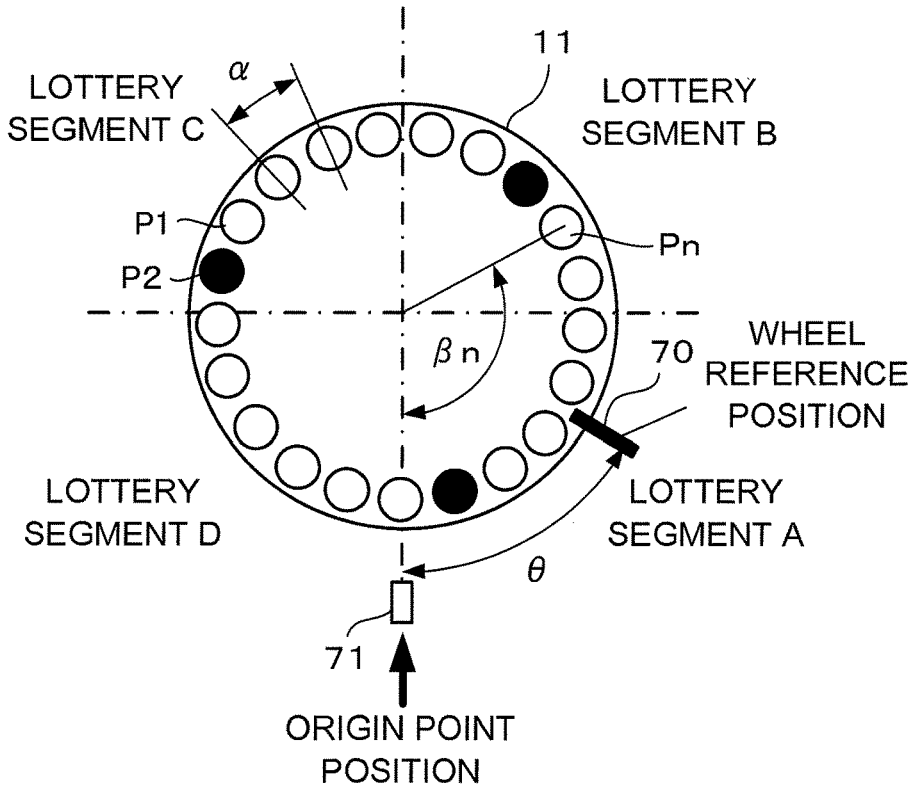
FIG. 10B is a figure showing a situation in which, from the state shown in FIG. 10A, the lottery wheel has been rotated through a predetermined angle.

Next the technique, when a lottery is being performed in the outer lottery segments 21, for determining the correspondence relationship between the pockets 14 and the lottery segments 21A through 21D will be explained with reference to FIGS. 10A and 10B. It should be understood that, in FIGS. 10A and 10B, a case is shown in which 21 pockets 14 are distinguished by the terms P1, P2, . . . P21. The pockets colored in black are special pockets. In this lottery device 3, a unique pocket number is set for each of the plurality of pockets 14. When the entrance of a ball B into any one of the pockets 14 has been detected, by acquiring the number of this pocket, it is uniquely specified into which one of the pockets 14 upon the lottery wheel 11 the ball B has entered. However, since the pocket numbers are set upon the lottery wheel 11, when the lottery wheel 11 is rotating, it is not possible to distinguish, only by the number of the pocket, from which lottery segment 21 this ball B has entered into the pocket 14. Accordingly, with this lottery device 3, as shown in FIG. 10A, an origin point position is set at a predetermined position on the outer circumference side of the lottery wheel 11, and a wheel reference position is also set upon the lottery wheel 11 itself. This origin point position is the position of an absolute origin that is set upon the casing 2. On the other hand, this wheel reference position is a reference position that is set upon the lottery wheel 11, and, as seen from the origin point position, this wheel reference position shifts along with the rotation of the lottery wheel 11.

If the rotation angle of the lottery wheel when the origin point position and the wheel reference position coincide is assumed to be 0°, and if the rotation angle of the lottery wheel 11 from this state assumed to be θ (refer to FIG. 10B), then the position of each of the pockets 14 when referred to the origin point position can be specified by employing the rotation angle θ and the angular spacing α between the pockets 14. For example, if a pocket 14 that is at an appropriate position when the rotation angle is 0°, for example the pocket number 1 is set for the pocket 14, that is positioned directly above the origin point position in FIG. 10A, and this pocket 14 is termed "pocket P1", then this pocket P1 is positioned at 180° from the origin point position. The angle at this time is taken as being the initial angle of the pocket P1. If the pocket number 2 is set for the adjacent pocket 14 in the direction of rotation and this pocket 14 is termed "pocket P2", then its initial angle is 180°+α°, and, in a similar manner, the initial angle βN0 of the pocket Pn for which the pocket number N is set is 180°+(N−1)α°. However, the upper limit for the initial angle βN0 is 360°, and if it would exceed 360°, then initial angle βN0 is considered as being the difference from 360°. It is possible to specify the initial angle βN0 of each of the pockets 14 in advance in this manner. Next, if the lottery wheel 11 has rotated through θ° as shown in FIG. 10B, the N-th pocket Pn is positioned an angle βn that is shifted by the position of its initial angle +θ° with respect to the origin point position. And moreover, in the case of an angle that would be greater than 360°, 360° is subtracted therefrom, just as before. In this manner, if the rotation angle θ° of the lottery wheel 11 is known, it is possible to obtain the angle βn of each of the pockets 14 from the origin point position uniquely.

On the other hand, the ranges of the lottery segments 21A through 21D (shown in FIGS. 10A and 10B by the suffixes A through D only) do not change with respect to the origin point position. In the example shown in the figure, with respect to the origin point position, the range that is greater than or equal to 0° and less than 90° is the lottery segment 21A, the range that is greater than or equal to 90° and less than 180° is the lottery segment 21B, the range that is greater than or equal to 180° and less than 270° is the lottery segment 21C, and the range that is greater than or equal to 270° and less than 360° is the lottery segment 21D. Accordingly, when the entrance of a ball B into any one of the pockets 14 has been detected, if the rotation angle of that pocket 14 from the origin point position is determined by adding the initial angle corresponding to the number of that pocket to the rotation angle θ°, and it is determined which is the one of the lottery segments 21A through 21D to whose angular range the rotation angle that has thus been obtained belongs, then it is possible to distinguish from which of the lottery segments 21 the ball B entered into the pocket 14.

In this lottery device 3, in order to detect the rotation angle θ, for example, an origin dog 70 may be installed at the wheel reference position of the lottery wheel 11, with a rotation angle sensor 71 being installed at the origin point position. Furthermore, a large number of rotation dogs 72 may be disposed around the lottery wheel 11 at appropriate angular positions in its circumferential direction (however, it will be supposed that these rotation dogs 72 are sufficiently smaller than the gap α°). If the number of detections of the rotation dogs 72 is counted by referring to the timing at which the rotation angle sensor 71 detects the origin dog 70, then it is possible to determine the rotation angle θ° of the lottery wheel 11 from the product of this count number and the angular gap between the rotation dogs 72. Accordingly, by outputting a signal that corresponds to the number of detections of the rotation dogs 72, and with reference to the position of detection of the origin dog 70, the rotation angle sensor 71 functions as an example of the displacement amount detection device.

Figure 11:
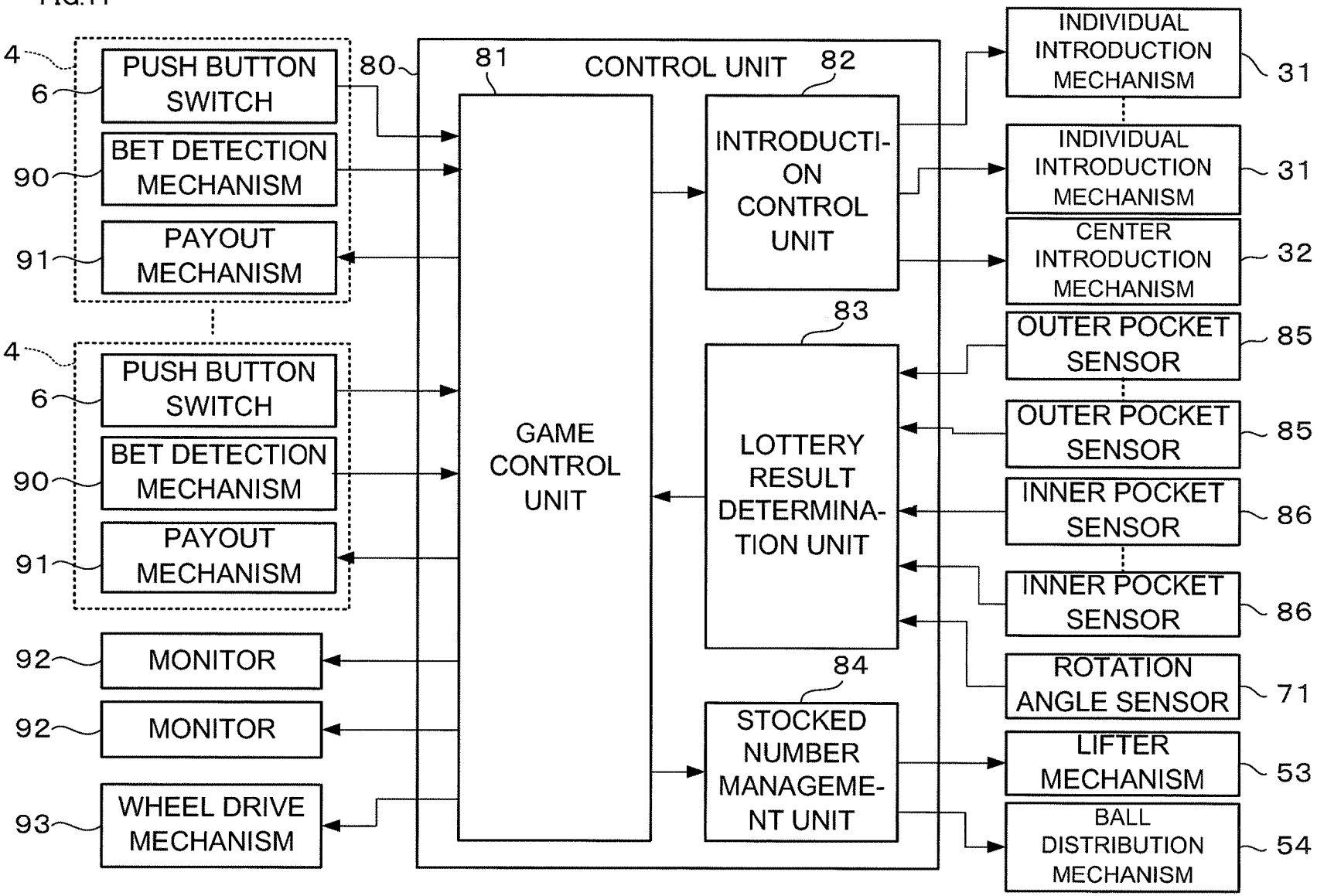
FIG. 11 is a block diagram of a control system of this game machine.

Next, the structure of the control system of this game machine 1 will be explained with reference to FIG. 11. The game machine 1 is provided with a control unit 80. This control unit 80 is a computer unit that includes a CPU and storage devices and so on as required for its operation. A game control unit 81, an introduction control unit 82, a lottery result determination unit 83, and a stocked number management unit 84 are provided by the control unit 80 as being logical devices that are implemented by combinations of computer hardware and software. The game control unit 81 executes processing of various types required for the game machine 1 to progress the game. The introduction control unit 82 controls the operation of the individual introduction mechanisms 31 and the center introduction mechanism 32 according to commands from the game control unit 81, so that balls B are selectively introduced onto the outer lottery segment 21 or the inner lottery segment 23. The lottery result determination unit 83 determines the result of the lottery on the basis of the output signals from outer pocket sensors 85, inner pocket sensors 86, and the rotation angle sensor 71, and provides the result of this determination to the game control unit 81. And the stocked number management unit 84 controls the operation of the lifter mechanism 53 and the ball distribution mechanism 54 so that an adequate number of stocked balls B are held within the respective ball guides 35 and 45 of the individual introduction mechanism 31 and the center introduction mechanism 32.

The outer pocket sensors 85 and the inner pocket sensors 86 are provided as examples of the entrance unit detection device. The outer pocket sensors 85 are sensors that are provided to correspond one-to-one to the pockets 14 on the outer periphery of the lottery wheel 11, and that individually detect the entrance of a ball B into each pocket 14. An identification number is set for each of the outer pocket sensors 85 so as to correspond to the pocket number set for pocket 14, and it is possible for the lottery result determination unit 83 to determine into which of the pockets 14 a ball B has entered by acquiring the identification number of the corresponding sensor. Furthermore, the lottery result determination unit 83 determines the rotation angle θ of the lottery wheel 11 by referring to the output signal from the rotation angle sensor 71, and determines in which lottery segment 21 the ball B entered into the pocket 14, on the basis of this rotation angle θ and the result of detection by the outer pocket sensor 85.

The inner pocket sensors 86 are sensors that are provided to correspond one-to-one to the pockets 24 provided upon the inner lottery segment 23, and that individually detect the entrance a ball B into each of the pockets 24. A unique pocket number is set for each of the pockets 24 as well, and an identification number is set for each of the inner pocket sensors 86, corresponding to the pocket number set for corresponding pocket 24. Thus, it is possible for the lottery result determination unit 83 to determine which of the pockets 24 a ball has entered into by acquiring the identification number thereof. It should be understood that, if unique pocket numbers are set for all of the pockets 14 and 24 and identification numbers are set for the pocket sensors so as to correspond to the pocket numbers, then it is not necessary to provide any means of distinguishing between the outer pocket sensors 85 and the inner pocket sensors 86.

A push button switch 6, a bet detection mechanism 90, and a payout mechanism 91 are provided for each station 4, and are connected to the game control unit 81. The push button switch 6 outputs a signal to the game control unit 81 corresponding to pushing down operation by the player. The bet detection mechanism 90 detects insertion of a medium such as a token or medal or the like or a coin from the input unit 5, and outputs a signal to the game control unit 81 corresponding to the number of such media inserted. And, according to a command from the game control unit 81, the payout mechanism 91 pays out a payout that has been won by the player. As one example, the payout may be paid out as a number of tickets corresponding to a payout amount, but it could be paid out in some other form.

Furthermore, monitors 92 and the wheel drive mechanism 93 are also connected to the game control unit 81 as control object thereof. A monitor 92 is provided to correspond to each of the stations 4, in a one-to-one correspondence. For example, for each station 4, the monitor 92 may be disposed in the region above the lottery field 10, so as to face the player at that station 4. This monitor 92 is provided for presenting to the player the state of progression of the game that is being played utilizing the lottery device 3, guidance of the game, and other information. The wheel drive mechanism 93 is a unit having an electric motor that serves as a source of drive power for driving to rotate the lottery wheel 11, a speed reduction device, and so on. Although this feature is not shown in FIG. 11, it should be understood that the ball sensors 44 of the individual introduction mechanism 31 and the ball sensors 50 of the center introduction mechanism 32 are also connected to the stocked number management unit 84. In this lottery device 3, for example, decorative illumination devices such as LEDs or the like may be provided as appropriately arranged along the guide rails 18, and control of those devices may also be performed by the game control unit 81. However, this feature is not shown in FIG. 11. It should be understood that, if the blinking of such decorative illumination devices is controlled to match a ball B as the ball B shifts along the guidance path 19, then it is possible to demonstrate the introduction of that ball B to the player clearly.

Figure 12:
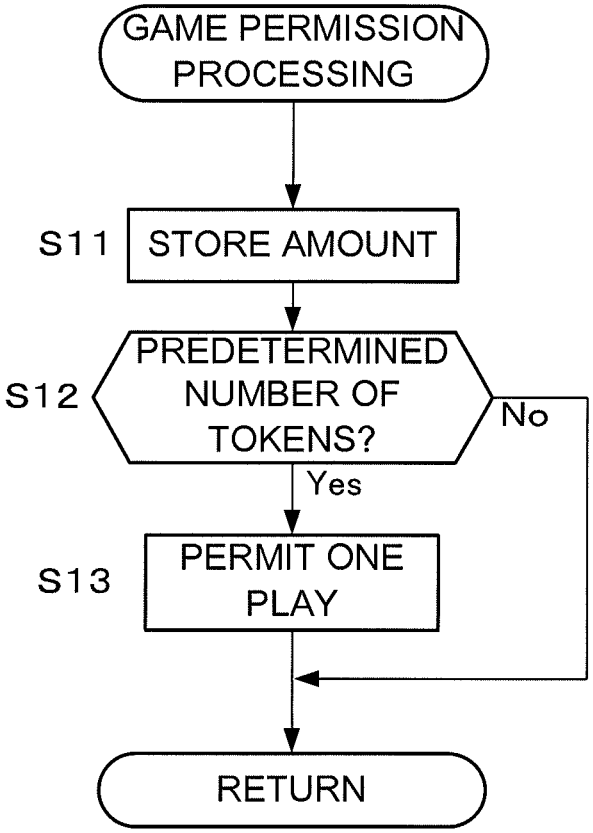
FIG. 12 is a flow chart showing an example of a procedure for game permission processing that is executed by a game control unit.

Next, various types of processing executed by the control unit 80 will be explained with reference to FIGS. 12 through 17. FIG. 12 is a flow chart showing an example of a procedure for game permission processing that is executed by the game control unit 81. When the bet detection mechanism 90 of one of the stations 4 detects the insertion of a token or the like, the game control unit 81 starts the game permission processing shown in FIG. 12, and first stores the amount inserted in association with the identification number of the station 4 (step S11). For example, when the insertion of a single token is detected by the bet detection mechanism 90 of the station 4A, the game control unit 81 adds 1 to the number of tokens inserted that is stored in association with the station number of the station 4A. Next, the game control unit 81 determines whether or not the number of tokens, after this addition, has reached a predetermined number of tokens (step S12). As one example, the number of tokens may be set to 5. When the stored value of the number of tokens inserted has reached the predetermined number of tokens, the game control unit 81 permits one play in relation to the station 4 for which it has been determined that the predetermined number of tokens has been reached (S13), and then terminates the processing of FIG. 12. On the other hand, if it is determined in step S12 that the predetermined number of tokens has not yet been reached, then the game control unit 81 skips the processing of step S13 and terminates the processing of FIG. 12.

Figure 13:
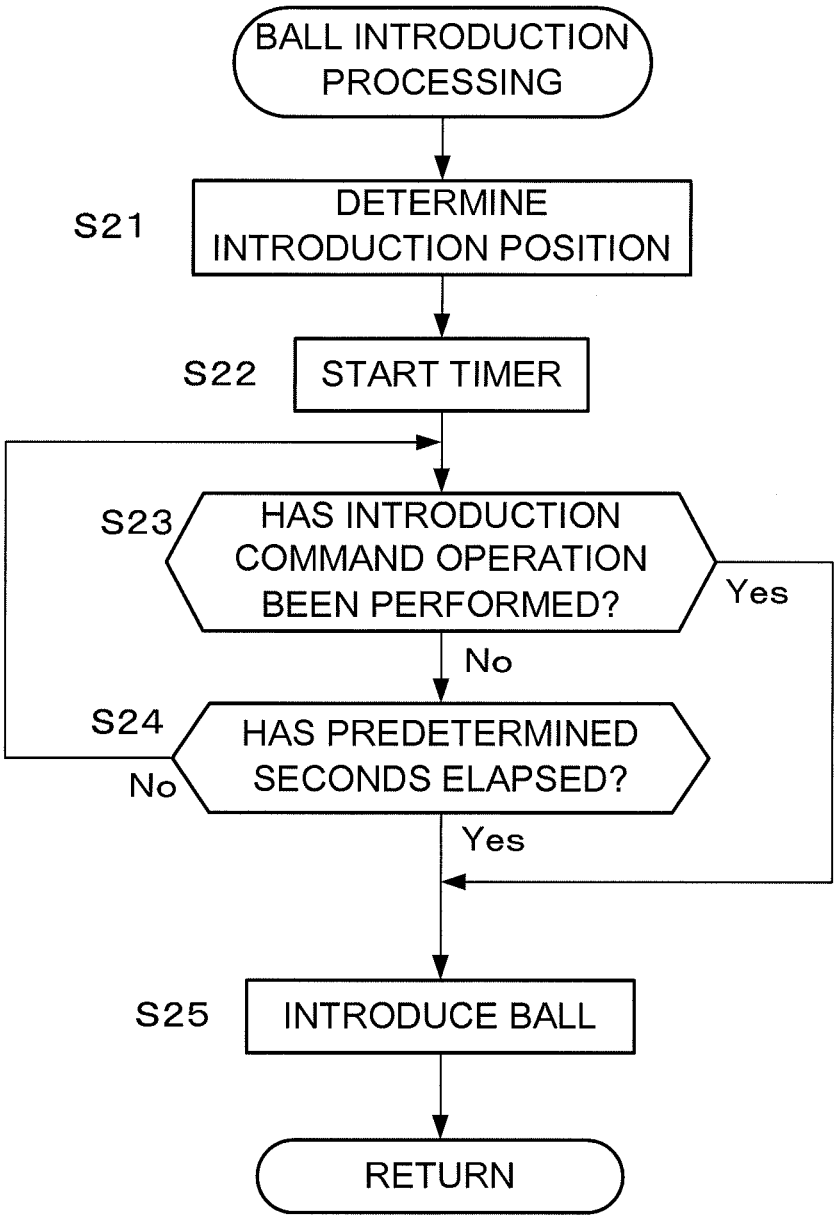
FIG. 13 is a flow chart showing an example of a procedure for ball introduction processing that is executed by an introduction control unit.

When one play is permitted by the processing of FIG. 12, the game control unit 81 commands the introduction control unit 82 to introduce a ball B as appropriate according to the procedure for this game that has been permitted, and acquires the result of this lottery from the lottery result determination unit 83. FIG. 13 is a flow chart showing an example of such a procedure for ball introduction processing that is executed by the introduction control unit 82 when the introduction of a ball is commanded. When the introduction of a ball is commanded, the introduction control unit 82 starts the processing of FIG. 13, and, first, determines the position where a ball B should be introduced on the basis of the command from the game control unit 81 (step S21). The position for introduction is one of the lottery segments 21A through 21D and the lottery segment 23. Next, the introduction control unit 82 starts a timer that times the elapsed time from the time point of issue of the introduction command (step S22), and then determines, via the game control unit 81, whether or not, at the station 4 where playing an episode of the game has been permitted, an introduction command operation has been performed, in other words whether or not push down operation of a push button switch 6 has been performed (step S23). If such an introduction command operation has not been performed, then the introduction control unit 82 determines whether or not predetermined seconds has elapsed after the starting of the timer in step S22 (step S24). As an example, the predetermined seconds may be set to 30 seconds. If the predetermined seconds has not elapsed, then the introduction control unit 82 returns the flow of control to step S23. But if the predetermined seconds has elapsed, then the introduction control unit 82 controls the operation of an individual introduction mechanism 31 or of the center introduction mechanism 32 so that one ball B is introduced at the introduction position determined in step S21 (step S25). Moreover, if it is determined in step S23 that an introduction command operation has been performed, then the introduction control unit 82 skips step S24 to advance the flow of control to step S25. In this case, the push button switch 6 functions as an example of the introduction command device. After a ball B has been introduced in step S25, the introduction control unit 82 terminates the processing of FIG. 13.

Figure 14:
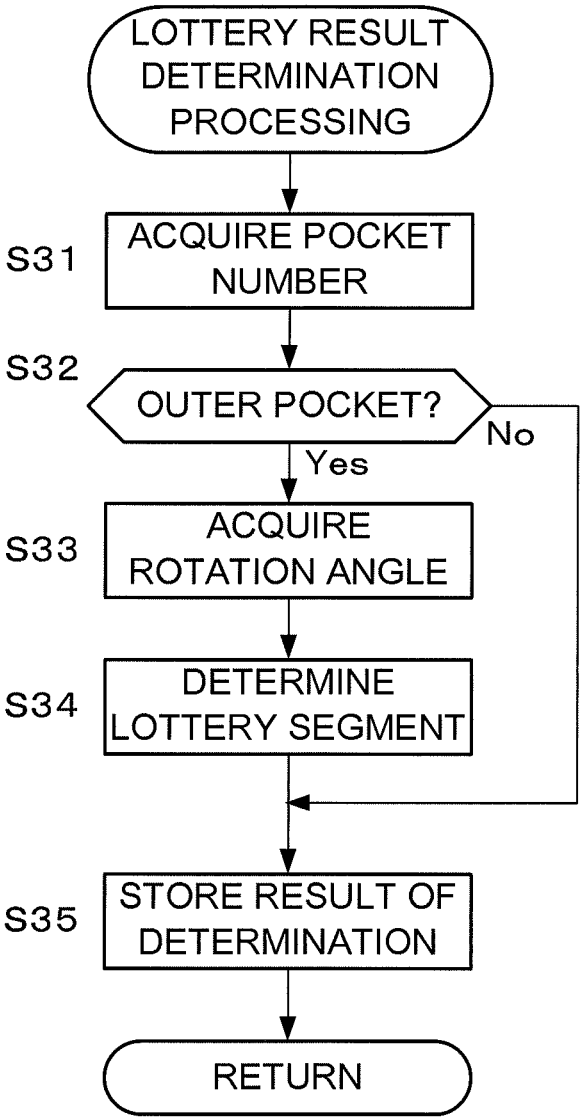
FIG. 14 is a flow chart showing an example of a procedure for lottery result determination processing that is executed by a lottery result determination unit.

FIG. 14 shows an example of a procedure for lottery result determination processing executed by the lottery result determination unit 83. When the entrance of a ball B is detected by one of the outer pocket sensors 85 and the inner pocket sensors 86, then the lottery result determination unit 83 starts the processing of FIG. 14, and first, on the basis of the identification number of the pocket sensor 85 (or 86) by which the entrance of the ball B has been detected, acquires the pocket number thereof (step S31). Next, the lottery result determination unit 83 determines whether or not the entrance of a ball B into an outer pocket 14 of the lottery wheel 11 has been detected (step S32), and, in the case of an outer pocket 14, acquires from the rotation angle sensor 71 its signal that corresponds to the rotation angle θ of the lottery wheel 11 (step S33). Furthermore, on the basis of the pocket number acquired in step S31 and the rotation angle θ acquired in step S33, the lottery result determination unit 83 determines from which of the lottery segments 21 the ball B entered into the pocket 14 (step S34). And then the lottery result determination unit 83 stores the result of this determination in a storage device of the control unit 80 (step S35). If the ball B has entered into an outer pocket 14, then, as the result of determination, the pocket number and the lottery segment 21 are stored in mutual association.

If it is determined in step S32 that the pocket is not an outer pocket, then the lottery result determination unit 83 skips steps S33 and S34, and the flow of control proceeds to step S35. In this case, the pocket number acquired in step S31 is stored as the result of determination. After having thus stored the result of determination in step S35, the lottery result determination unit 83 terminates the processing of FIG. 14.

Figure 15:
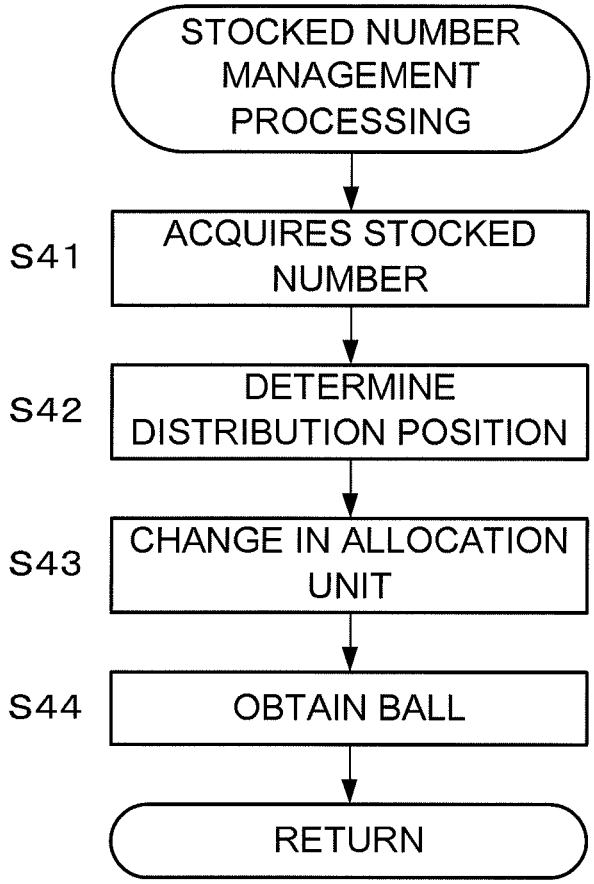
FIG. 15 is a flow chart showing an example of a procedure for stocked number management processing that is executed by a stocked number management unit.

FIG. 15 shows an example of a procedure for stocked number management processing that is executed by the stocked number management unit 84. This processing is repeatedly executed upon a fixed cycle. When the processing of FIG. 15 starts, first, the stocked number management unit 84 refers to the outputs of the ball sensors 44 of the individual introduction mechanisms 31 and to the outputs of the ball sensors 50 of the center introduction mechanism 32, and acquires the stocked numbers of balls B in each of the individual introduction mechanisms 31 and the center introduction mechanism 32 (step S41). Next, the stocked number management unit 84 determines which one, among the introduction mechanisms 31 and 32, is the one whose stocked number is the smallest, and takes that one as being the distribution position for a ball B (step S42). And next the stocked number management unit 84 changes over control of the positions of the selector 61 of the primary allocation unit 56 and the positions of the gates 66 of the secondary allocation units 59 of the ball distribution mechanism 54 so that a ball B is supplied to the distribution position that was determined in step S42, and thereby a route is created for a ball B to shift from the lifter mechanism 53 to the distribution position (step S43). Then the stocked number management unit 84 operates the lifter mechanism 53 to discharge a ball B to the ball distribution mechanism 54 (step S44). Due to this, the ball B is guided to the distribution position, and the stocked number at this distribution position increases. After this, the stocked number management unit 84 terminates the processing of FIG. 15. It should be understood that it would be acceptable for the processing procedure to be set so that, in a single episode of processing, a plurality of balls are supplied to the same distribution position. Alternatively, it would also be acceptable to change the stocked number management processing procedure so that the lifter mechanism 53 is operated intermittently at regular intervals, and so that the processing of step S41 through S43 of FIG. 15 is executed matched to the cycle at which balls B are discharged from the lifter mechanism 53.

Figure 16:
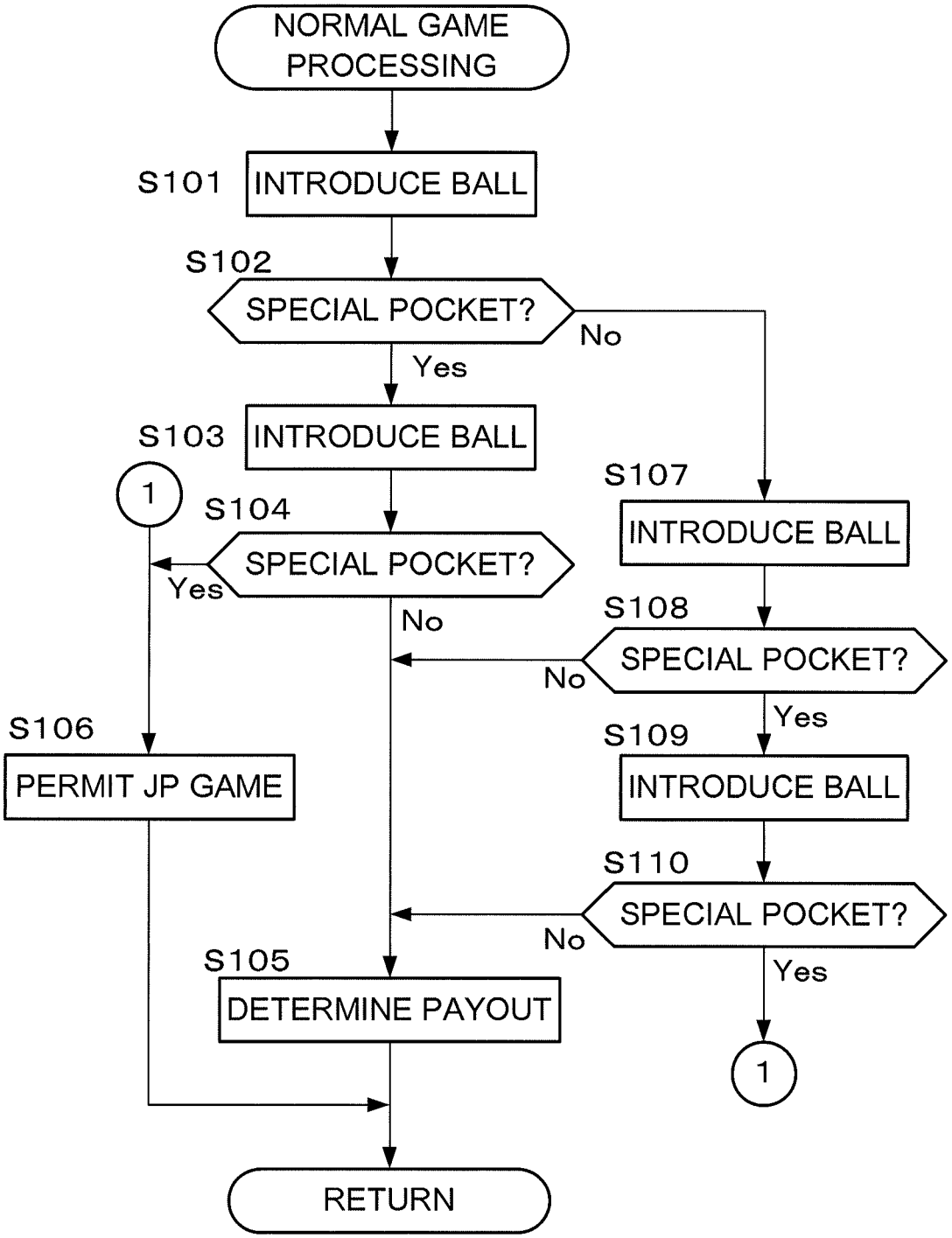
FIG. 16 is a flow chart showing an example of a procedure for normal game processing that is executed by the game control unit.
Figure 17:
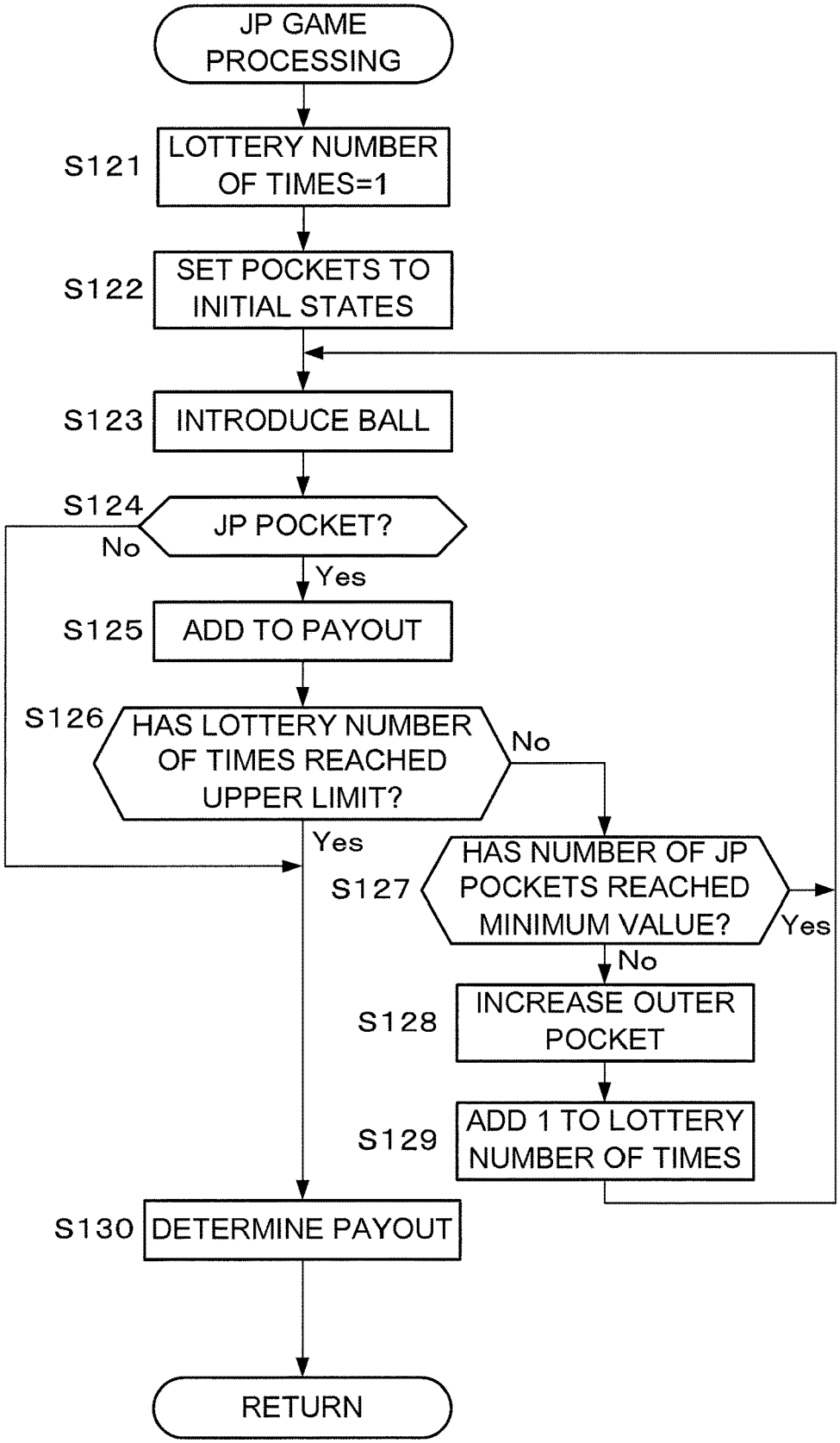
FIG. 17 is a flow chart showing an example of a procedure for JP game processing that is executed by the game control unit.

FIGS. 16 and 17 show examples of a procedure for game processing executed by the game control unit 81. The game control unit 81 controls the game to direct its progression to become a normal game in which the outer lottery segment 21 is employed, or a jackpot game (hereinafter termed a "JP game") in which the inner lottery segment 23 is employed. FIG. 16 shows an example of a procedure for normal game processing. This normal game processing is executed when a single play episode is permitted by the processing of FIG. 12, and is executed for the station 4 that has obtained that permission. However, when single play episodes are permitted for a plurality of the stations 4 at the same time, then the game control unit 81 executes normal game processing for each of the stations 4 in parallel. It should be understood that, hereinafter, the explanation will be continued under the assumption that the station 4 on which permission for one play episode has been obtained is the station 4A. If the station that has obtained permission for one episode of play is one of the stations 4B through 4D, then the described processing can be applied just as it is, with the suffix "A" of the station 4A being changed to one of "B" through "D".

When the processing for a normal game is started with the station 4A as subject, the game control unit 81 commands the introduction control unit 82 to introduce one ball B onto the lottery segment 21A that corresponds to the first station 4A (step S101). In response to this command, the introduction control unit 82 starts the ball introduction processing of FIG. 13, and thereby causes a ball B to be introduced from the individual introduction mechanism 31A that corresponds to the lottery segment 21A. And next the game control unit 81 acquires the lottery result determination for the station 4A from the lottery result determination unit 83, and determines whether or not the ball B has entered into a special pocket 14S (step S102). In this case, since this lottery is performed in the outer lottery segment 21A, as a result obtained by the lottery result determination processing of FIG. 14, the lottery result determination unit 83 stores information specifying into which of the pockets 14 the ball B that had been introduced on the lottery segment 21A has entered. Therefore, according to these stored details, the game control unit 81 can determine whether or not the ball B entered into one of the special pockets 14S.

If the ball B enters into one of the special pockets 14S, then the game control unit 81 commands the introduction control unit 82 to introduce one more ball B (step S103), and determines whether or not, as a result, this new ball B introduced by the lottery segment 21A has entered into a special pocket 14S (step S104). If the ball has not entered into a special pocket 14S, then the game control unit 81 calculates a payout for a normal game (step S105). The payout may, for example, be determined according to the attributes set for the pocket 14. For example, if the ball B enters into a pocket 14 having attributes determined so that the probability of the ball B entering is relatively low, then the payout is determined so that the amount of payout becomes higher than in a case in which the ball B has entered into a pocket whose attributes imply that the probability is relatively high.

If in step S104 it is determined that the ball B has entered into one of the special pockets 14S, then the game control unit 81 permits a JP game (step S106). In other words, a JP game is permitted when the ball B has successively entered into a special pocket 14S twice in one episode of a normal game. If it has been determined in step S102 that the ball B has not entered into a special pocket 14S, then the game control unit 81 commands the introduction control unit 82 to introduce a second ball (step S107), and determines whether or not, as a result, this new ball B introduced onto the lottery segment 21A has entered into a special pocket 14S (step S108). If the new ball B has not entered into a special pocket 14S, then the game control unit 81 transfers the flow of control to step S105 and calculates a payout.

On the other hand, in step S108, if it is determined that the ball B from the lottery segment 21A has entered into a special pocket 14S, then the game control unit 81 commands the introduction control unit 82 to introduce a third ball (step S109). This is a process for giving the player a chance to proceed to a JP game under the condition that the ball B successively enters into a special pocket 14S twice. After having commanded the introduction of a third ball in step S109, the game control unit 81 determines whether or not this third ball B introduced onto the lottery segment 21A has entered into a special pocket 14S (step S110). If the ball has not entered into a special pocket 14S, then the game control unit 81 transfers the flow of control to step S105, while if the ball has so entered, then the flow of control is transferred to step S106. When step S105 or step S106 is executed, the game control unit 81 terminates the processing of FIG. 16.

However, if a JP game is permitted in step S106, then the game control unit 81 starts the processing of FIG. 17 with the station 4A as the subject. Since the processing of FIG. 17 is performed by employing the inner lottery segment 23, accordingly, if a JP game that employs the inner lottery segment 23 is already being executed with one of the stations 4B through 4D as a subject, then the game control unit 81 starts the processing of FIG. 17 after having waited for the end of that game.

When the JP game processing of FIG. 17 starts, the game control unit 81 sets a lottery number of times to an initial value of 1 (step S121), and sets the attribute of the pockets 24 to their initial states (step S122). In a JP game, the attribute of the pocket 24 is set to one of "jackpot pocket" (hereinafter termed "JP pocket") or "outer pocket", but, in the initial state, at least the greater portion of the pockets 24 in the inner lottery segment 23 are set to be JP pockets.

Next, the game control unit 81 commands the introduction control unit 82 to introduce one ball B onto the inner lottery segment 23 (step S123). In response to this command, the introduction control unit 82 starts the ball introduction processing of FIG. 13, and causes a ball B to be introduced from the center introduction mechanism 32. And next the game control unit 81 acquires the lottery result determination related to the inner lottery segment 23 from the lottery result determination unit 83, and determines whether or not the ball B has entered into one of the JP pockets 24 (step S124). If the ball B has entered into one of the JP pockets 24, then the game control unit 81 adds a predetermined amount to the payout for the player (step S125), and then determines whether or not the lottery number of times has reached a predetermined upper limit, for example ten times (step S126). If the upper limit has not yet been reached, then the game control unit 81 determines whether or not the number of JP pockets 24 has reached a predetermined minimum value, for example one (step S127), and, if it has not reached the minimum value, changes the set attributes of the pockets 24 so that the number of outer pockets 24 is increased by one and the number of JP pockets 24 is reduced by one (step S128). Thereafter, the game control unit 81 adds 1 to the lottery number of times, and the flow of control returns to step S123. But, in step S127, if it has been determined that the minimum value has been reached, then the game control unit 81 skips the step S127 and the step S128, and the flow of control returns to step S123.

In step S124, if it is determined that the ball B has not entered into a JP pocket 24, in other words if it is determined that the ball B has entered into an outer pocket 24, then the game control unit 81 skips steps S125 and S126, and the flow of control proceeds to step S130. That is, the JP game ends if the ball B enters into an outer pocket 24 even once. And also, if it is determined in step S126 that the lottery number of times has reached the upper limit, then the game control unit 81 advances the flow of control to step S130. In step S130, the game control unit 81 determines the payout to the player. In this case, the payout is a value obtained by adding the amount of payout that was determined in step S125 to the payout for normal game processing. After determination of the payout in step S130, the game control unit 81 terminates the processing of FIG. 17.

In the embodiment described above, by executing the processing of FIGS. 12 and 16, the game control unit 81 functions as an example of the game control device, and, by executing the processing of steps S33 and S34 of FIG. 14, the lottery result determination unit 83 functions as an example of the lottery segment distinguishing device. Moreover, by executing the processing of FIG. 13, the introduction control unit 82 functions as an example of the introduction control device, and, by executing the processing of FIG. 13 in response to the command in step S123 of FIG. 17, also functions as an example of the internal introduction control device. And, by executing the processing of FIG. 15, the stocked number management unit 84 functions as an example of the supply control device.

The present invention is not to be considered as being limited to the embodiment described above, and it could be implemented in forms in which various changes of modifications have been introduced. For example, the inner lottery segment 23 need not necessarily be provided, and it would also be acceptable to omit it, as appropriate. On the other hand, if it is possible to secure sufficient space inside the drawing body, or in the center unit, then it would also be acceptable to divide the interior of the drawing body into two or more lottery segments, and to provide a medium introduction mechanism that is adapted to be capable of introducing game media onto those lottery segments individually. Moreover, the medium entrance units of the drawing body are not to be considered as being limited to the shown example in which they are lined up around the circumferential direction at a constant spacing. It would also be possible for the medium entrance units to be lined up around the circumferential direction at non-uniform intervals, or for a plurality of the medium entrance units to be lined up around the circumferential direction while their positions in the radial direction are varied. Furthermore, the drawing body is not to be considered as being limited to the shown example in which it rotates around a predetermined axial line, as the lottery wheel 11 does. For example, it would be acceptable to provide a belt-like drawing body that circulates around a predetermined path and a driving mechanism for such a drawing body. Yet further, the detection of the displacement amount of the drawing body in the circumferential direction is not to be considered as being limited to the shown example in which that displacement amount is detected as a rotation angle. For example, it would also be acceptable to detect the displacement of the drawing body in the circumferential direction by detecting the drive amount or the drive time of a driving mechanism that drives the drawing body. Even further, the displacement amount of the drawing body could also be detected in various other ways. Additionally, the medium introduction mechanism is not to be considered as being limited to the shown example in which the game media are introduced via a guidance path that is shaped as a spiral. The path along which the game media are introduced may be varied as appropriate. For example, it would also be acceptable to build the medium introduction mechanism so that the game media are introduced from the vertical direction of the lottery segment, or from its radial direction or the like. Moreover, the medium introduction mechanism is not to be considered as being limited to the shown example in which the game media are taken out from a common medium reservoir unit and are distributed to unit introduction mechanisms. The retrieval and introducing of the game media may be managed independently for each of the medium introduction mechanisms. And the commands for introducing the game media are not to be considered as being limited to the shown example in which they are issued from terminal units that are integrated with the lottery device, as the stations 4 are, or from an operation unit. For example, it would also be acceptable for the introduction commands to be issued from terminal devices that are connected to the lottery device via a network. And finally, the introduction commands are not limited to being issued on the basis of operation by players (or users). For example, it would also be acceptable for a lottery using any one of the plurality of lottery segments to be permitted when a predetermined condition in the game is satisfied, and for an introduction command to be issued as a response to this permission.

A game machine to which this lottery device is applied is not to be considered as being limited to executing the normal game and the JP game described above. The game machine may be varied as appropriate, provided that it has a form in which, in a lottery device, the progression of the game is controlled for each of a plurality of lottery segments on the basis of the lottery results for those lottery segments. For example, in the game machine 1 described above, it would also be acceptable to adapt the game machine so that some of the outer pockets 14 are set as outer pockets, and, provided that a ball B does not enter into one of the outer pockets, the lottery is executed repeatedly, within the range that the number of repetitions does not exceed a predetermined upper limit number. Alternatively, it will also be acceptable for the game machine to be adapted so that it is made possible to bet in advance on the ball B entering into an outer pocket, and so that a high payout is obtained if the ball B enters into an outer pocket.

Various aspects of the present invention derived from each of the embodiments and variant embodiments detailed above will now be described. It should be understood that, in the following explanation, in order to facilitate understanding of each aspect of the present invention, the members corresponding to elements shown in the attached drawings are labeled in parentheses, but the present invention is not, due to this, to be considered as being limited to the forms shown in the figures.

A lottery device (3) according to one aspect of the present invention comprises: a drawing body (11) having a plurality of medium entrance units (14) which are provided along a circumferential direction thereof, and into each of which a game medium (B) is capable of entering; a driving mechanism (93) that drives the drawing body in the circumferential direction; a dividing device (18, 20) that divides a periphery of a path of the plurality of medium entrance units of the drawing body, in which path the plurality of medium entrance units travel, into a plurality of lottery segments (21A through 21D) in the circumferential direction so that the game medium is unable to interchange between the lottery segments; a medium introduction mechanism (30) that is provided so as to be capable of introducing the game medium individually into each of the plurality of lottery segments; an entrance unit detection device (85) that detects a medium entrance unit into which the game medium has entered; a displacement amount detection device (71) that detects an amount of displacement (θ) in the circumferential direction of the drawing body; and a lottery segment distinguishing device (83, S33, S34) that distinguishes from which of the lottery segments, among the plurality of lottery segments, the game medium has entered into the medium entrance unit based on a result of detection by the displacement amount detection device.

In the lottery device of the aspect of the present invention described above, there may be further comprised: a plurality of introduction command devices (6) for which a respective correspondence relationship with the plurality of lottery segments is set; and an introduction control device (82, S21 through S25) that, in response to an introduction command from any one of the introduction command devices, controls the medium introduction mechanism so that the game medium is introduced into a lottery segment which corresponds to the one introduction command device.

With the lottery device of the aspect of the present invention described above:

the drawing body may be provided so as to be rotatable around an axis of rotation in a vertical direction; each of the plurality of medium entrance units may be provided so that the game medium enters from an outer peripheral side of the path; and the dividing device may be provided so as to divide a region on the outer peripheral side of the path into the plurality of lottery segments.

Moreover, the medium introduction mechanism may further comprise a guidance device (18) that guides the game medium so that the game medium is introduced into each of the lottery segments during shifting in a direction along an outer periphery of the plurality of lottery segments.

Yet further, the guidance device may be provided so that a guidance path (19) extending in a spiral shape along the outer periphery of the plurality of lottery segments is defined for each lottery segment.

In a region of the drawing body on an inner circumferential side of the path, a lottery segment (23) may be further provided that has a plurality of medium entrance units (24) so that the game medium is unable to interchange between the plurality of lottery segments on the outer peripheral side of the path and those on the inner circumferential side; and the medium introduction mechanism may be provided so as to be capable of introducing the game medium into the lottery segment on the inner circumferential side, and distinguishing introduction thereinto from introduction of the game medium into each of the plurality of lottery segments on the outer peripheral side.

With the mode of the present invention described above, in the lottery device, a special entrance unit (14S) may be provided in apart of the plurality of medium entrance units corresponding to the plurality of lottery segments on the outer peripheral side, and configured so that entrance of the game medium thereinto becomes more difficult than another medium entrance unit; and the lottery device may further comprise an internal introduction control device (82) that controls the medium introduction mechanism so that the game medium is introduced into the lottery segment (23) on the inner circumferential side when achieving at least one condition in which the entrance of the game medium into the special entrance unit has been detected.

In the lottery device according to the aspect of the present invention described above, the medium introduction mechanism may be provided so as to take out the game medium from a medium reservoir unit (52) that is shared between the plurality of lottery segments, and so as to introduce the game medium individually into each of the plurality of lottery segments.

With the mode of the present invention described above, the medium introduction mechanism may further comprise: a unit introduction mechanism (31, 32) provided for each of the lottery segments, and being capable of changing over between introducing the game medium and stopping the introducing; and a medium supply mechanism (33) that selectively supplies the game medium taken out from the medium reservoir unit to the unit introduction mechanisms.

Furthermore, an individual holding portion (35, 45) that is capable of holding a plurality of game media may be provided to each of the unit introduction mechanisms.

Even further, this lottery device may further comprise a supply control device (84, S41 through S44) that controls the medium supply mechanism so that the game medium taken out from the medium reservoir unit is distributed to any one of the unit introduction mechanisms based on a number of game media held by the individual holding portions of each unit introduction mechanism.

And a game machine (1) according to an aspect of the present invention comprises: a lottery device (3) according to any one of the aspects or modes described above; and a game control device (81) that refers to a result of detection by the entrance detection device and to a result of distinguishing by the lottery segment distinguishing device, and that controls progression of a game for each of the plurality of lottery segments divided by the dividing device.

What is claimed is:

1. A lottery device, comprising:

a drawing body having a plurality of medium entrance units which are provided along a circumferential direction thereof, and into each of which a game medium configured for entering;

a driving mechanism that drives the drawing body in the circumferential direction;

a dividing device that divides a periphery of a path of the plurality of medium entrance units of the drawing body, in which path the plurality of medium entrance units travel, into a plurality of lottery segments in the circumferential direction so that the game medium is unable to interchange between the lottery segments;

a medium introduction mechanism that is provided so as to be configured for introducing the game medium individually into each of the plurality of lottery segments;

an entrance unit detection device that detects a medium entrance unit into which the game medium has entered;

a displacement amount detection device that detects an amount of displacement in the circumferential direction of the drawing body; and a lottery segment distinguishing device that distinguishes from which of the lottery segments, among the plurality of lottery segments, the game medium has entered into the medium entrance unit based on a result of detection by the displacement amount detection device.

2. The lottery device according to claim 1, further comprising:

a plurality of introduction command devices for which a respective correspondence relationship with the plurality of lottery segments is set; and an introduction control device that, in response to an introduction command from any one of the introduction command devices, controls the medium introduction mechanism so that the game medium is introduced into a lottery segment which corresponds to the one introduction command device.

3. The lottery device according to claim 1, wherein:

the drawing body is provided so as to be rotatable around an axis of rotation in a vertical direction;

each of the plurality of medium entrance units is provided so that the game medium enters from an outer peripheral side of the path; and the dividing device is provided so as to divide a region on the outer peripheral side of the path into the plurality of lottery segments.

4. The lottery device according to claim 3, wherein the medium introduction mechanism further comprises a guidance device that guides the game medium so that the game medium is introduced into each of the lottery segments during shifting in a direction along an outer periphery of the plurality of lottery segments.

5. The lottery device according to claim 4, wherein the guidance device is provided so that a guidance path extending in a spiral shape along the outer periphery of the plurality of lottery segments is defined for each lottery segment.

6. The lottery device according to claim 3, wherein:

in a region of the drawing body on an inner circumferential side of the path, a lottery segment is further provided that has a plurality of medium entrance units so that the game medium is unable to interchange between the plurality of lottery segments on the outer peripheral side of the path and those on the inner circumferential side; and the medium introduction mechanism is provided so as to be capable of configured for introducing the game medium into the lottery segment on the inner circumferential side, and distinguishing introduction thereinto from introduction of the game medium into each of the plurality of lottery segments on the outer peripheral side.

7. The lottery device according to claim 6, wherein:

a special entrance unit is provided in a part of the plurality of medium entrance units corresponding to the plurality of lottery segments on the outer peripheral side, and configured so that entrance of the game medium thereinto becomes more difficult than another medium entrance unit; and the lottery device further comprises an internal introduction control device that controls the medium introduction mechanism so that the game medium is introduced into the lottery segment on the inner circumferential side when achieving at least one condition in which the entrance of the game medium into the special entrance unit has been detected.

8. The lottery device according to claim 1, wherein the medium introduction mechanism is provided so as to take out the game medium from a medium reservoir unit that is shared between the plurality of lottery segments, and so as to introduce the game medium individually into each of the plurality of lottery segments.

9. The lottery device according to claim 8, wherein the medium introduction mechanism further comprises:

a unit introduction mechanism provided for each of the lottery segments, and configured for changing over between introducing the game medium and stopping the introducing; and a medium supply mechanism that selectively supplies the game medium taken out from the medium reservoir unit to the unit introduction mechanisms.

10. The lottery device according to claim 9, wherein an individual holding portion that is configured for holding a plurality of game media is provided to each of the unit introduction mechanisms.

11. The lottery device according to claim 10, further comprising a supply control device that controls the medium supply mechanism so that the game medium taken out from the medium reservoir unit is distributed to any one of the unit introduction mechanisms based on a number of game media held by the individual holding portions of each unit introduction mechanism.

12. A game machine, comprising:

a drawing body having a plurality of medium entrance units which are provided along a circumferential direction thereof, and into each of which a game medium is configured for entering;

a driving mechanism that drives the drawing body in the circumferential direction;

a dividing device that divides a periphery of a path of the plurality of medium entrance units of the drawing body, in which path the plurality of medium entrance units travel, into a plurality of lottery segments in the circumferential direction so that the game medium is unable to interchange between the lottery segments;

a medium introduction mechanism that is provided so as to be configured for introducing the game medium individually into each of the plurality of lottery segments;

an entrance unit detection device that detects a medium entrance unit into which the game medium has entered;

a displacement amount detection device that detects an amount of displacement in the circumferential direction of the drawing body; and a lottery segment distinguishing device that distinguishes from which of the lottery segments, among the plurality of lottery segments, the game medium has entered into the medium entrance unit based on a result of detection by the displacement amount detection device; and a game control device that refers to a result of detection by the entrance detection device and to a result of distinguishing by the lottery segment distinguishing device, and that controls progression of a game for each of the plurality of lottery segments divided by the dividing device.

* * * * *